US010731908B2

(12) United States Patent
Olvera et al.

(10) Patent No.: US 10,731,908 B2
(45) Date of Patent: Aug. 4, 2020

(54) REFRIGERATION APPLIANCE WITH COLD AIR SUPPLY FOR ICE MAKER AND ICE LEVEL SENSOR

(71) Applicant: Electrolux Home Products, Inc., Charlotte, NC (US)

(72) Inventors: Jose Carlos Trejo Olvera, Anderson, SC (US); Thomas McCollough, Anderson, SC (US); Cornel Comsa, Anderson, SC (US); Nilton Carlos Bertolini, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 118 days.

(21) Appl. No.: 15/497,274

(22) Filed: Apr. 26, 2017

(65) Prior Publication Data

US 2018/0313593 A1 Nov. 1, 2018

(51) Int. Cl.
*F25C 1/24* (2018.01)
*F25C 5/187* (2018.01)
(Continued)

(52) U.S. Cl.
CPC ..... *F25C 1/24* (2013.01); *F25C 5/187* (2013.01); *F25C 5/22* (2018.01); *F25D 17/065* (2013.01); *F25D 17/08* (2013.01); *F25C 2400/10* (2013.01); *F25C 2500/08* (2013.01); *F25C 2700/02* (2013.01)

(58) Field of Classification Search
CPC .. F25C 5/187; F25C 1/24; F25D 17/08; F25D 17/042; F25D 2317/061; F25D 2317/0671; F24F 7/065; F24F 13/02
See application file for complete search history.

(56) References Cited

U.S. PATENT DOCUMENTS 2,962,872 A * 12/1960 Crotser ..... F25D 17/062 62/155
4,822,996 A 4/1989 Lind
(Continued)

FOREIGN PATENT DOCUMENTS

EP 1559972 8/2005
EP 2154454 2/2010

OTHER PUBLICATIONS

International Search Report for PCT/US2018/029004, dated Sep. 24, 2018, 2 pages.

*Primary Examiner* — Marc E Norman
*Assistant Examiner* — Schyler S Sanks
(74) *Attorney, Agent, or Firm* — Pearne & Gordon LLP

(57) ABSTRACT

A refrigeration appliance includes an ice maker disposed in a fresh food compartment. An air handler assembly conveys cooling air through the ice maker. An insulated air duct is disposed between an evaporator and a fan for preventing the migration of ice from the evaporator to the fan. The insulated duct has an opening extending from an end adjacent the evaporator to an end adjacent the fan. A lower inner wall of the air duct has a first ramped portion on the end adjacent the evaporator. In another example, the icemaker includes a sensor assembly positioned to detect a level of ice in the ice bin. The sensor assembly includes an emitter for sending photons along a predetermined path, and a receiver for detecting the photons when the photons are reflected off an object disposed in the predetermined path.

15 Claims, 18 Drawing Sheets

(51) Int. Cl.

| | |
|---|---|
| ***F25D 17/06*** | (2006.01) |
| ***F25D 17/08*** | (2006.01) |
| ***F25C 5/20*** | (2018.01) |

(56) References Cited

U.S. PATENT DOCUMENTS

| | | | | |
|---|---|---|---|---|
| 6,014,868 | A | 1/2000 | Hirosawa et al. | |
| 6,286,324 | B1 | 9/2001 | Pastryk et al. | |
| 6,414,301 | B1 | 7/2002 | Borg, Jr. et al. | |
| 6,581,392 | B1 | 6/2003 | Gist et al. | |
| 7,222,497 | B2 | 5/2007 | An et al. | |
| 7,472,552 | B2 | 1/2009 | An et al. | |
| 7,610,772 | B2 | 11/2009 | Braun et al. | |
| 7,779,641 | B2 | 8/2010 | Lee et al. | |
| 7,856,845 | B2 | 12/2010 | Fotiadis et al. | |
| 8,156,748 | B2 | 4/2012 | Ashrafzadeh et al. | |
| 8,159,660 | B2 | 4/2012 | Mimeault et al. | |
| 8,181,471 | B2 | 5/2012 | Heger et al. | |
| 8,196,419 | B2 | 6/2012 | Woo | |
| 8,242,323 | B2 | 8/2012 | Jain et al. | |
| 8,393,164 | B2 | 3/2013 | Kim et al. | |
| 8,484,987 | B2 | 7/2013 | Ducharme et al. | |
| 8,488,110 | B2 | 7/2013 | Hug et al. | |
| 8,616,013 | B2 | 12/2013 | Kim et al. | |
| 8,616,018 | B2 | 12/2013 | Jeong et al. | |
| 8,635,877 | B2 | 1/2014 | Kim et al. | |
| 8,646,285 | B2 | 2/2014 | Choi et al. | |
| 8,713,949 | B2 | 5/2014 | Chase et al. | |
| 8,776,544 | B2 | 7/2014 | McCollough et al. | |
| 8,820,110 | B2 | 9/2014 | Schenk et al. | |
| 8,875,536 | B2 | 11/2014 | Jeong et al. | |
| 8,959,939 | B2 | 2/2015 | Kim et al. | |
| 9,032,745 | B2 | 5/2015 | Ashrafzadeh et al. | |
| 9,097,450 | B2 | 8/2015 | Kim et al. | |
| 2006/0026033 | A1 | 11/2006 | Wetekamp | |
| 2008/0034780 | A1 | 2/2008 | Lim et al. | |
| 2009/0211292 | A1* | 8/2009 | Smith | F25C 5/187 62/344 |
| 2010/0315654 | A1 | 12/2010 | Berger | |
| 2011/0203305 | A1* | 8/2011 | Schenk | F25C 1/08 62/344 |
| 2013/0192279 | A1* | 8/2013 | McCollough | F25D 21/08 62/66 |
| 2013/0233007 | A1 | 9/2013 | Stock | |
| 2015/0013374 | A1 | 1/2015 | Jeong et al. | |
| 2015/0121942 | A1 | 5/2015 | Yun et al. | |
| 2015/0241106 | A1 | 8/2015 | Chase et al. | |
| 2016/0201967 | A1* | 7/2016 | Mitchell | F25D 29/005 62/135 |
| 2016/0370091 | A1 | 12/2016 | Koo | |

* cited by examiner

REFRIGERATION APPLIANCE WITH COLD AIR SUPPLY FOR ICE MAKER AND ICE LEVEL SENSOR

FIELD OF THE INVENTION

This application relates generally to an ice maker for a refrigeration appliance, and more particularly, to a refrigeration appliance including an ice maker disposed within a fresh food compartment of a refrigerator that is maintained at a temperature above a freezing temperature of water at atmospheric conditions.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C. and the freezer compartments at temperatures below 0° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Such conventional refrigerators are often provided with a unit for making ice pieces, commonly referred to as "ice cubes" despite the non-cubical shape of many such ice pieces. These ice making units normally are located in the freezer compartments of the refrigerators and manufacture ice by convection, i.e., by circulating cold air over water in an ice tray to freeze the water into ice cubes. Storage bins for storing the frozen ice pieces are also often provided adjacent to the ice making units. The ice pieces can be dispensed from the storage bins through a dispensing port in the door that closes the freezer to the ambient air. The dispensing of the ice usually occurs by means of an ice delivery mechanism that extends between the storage bin and the dispensing port in the freezer compartment door.

However, for refrigerators such as the so-called "bottom mount" refrigerator, which includes a freezer compartment disposed vertically beneath a fresh food compartment, placing the ice maker within the freezer compartment is impractical. Users would be required to retrieve frozen ice pieces from a location close to the floor on which the refrigerator is resting. And providing an ice dispenser located at a convenient height, such as on an access door to the fresh food compartment, would require an elaborate conveyor system to transport frozen ice pieces from the freezer compartment to the dispenser on the access door to the fresh food compartment. Thus, ice makers are commonly included in the fresh food compartment of bottom mount refrigerators, which creates many challenges in making and storing ice within a compartment that is typically maintained above the freezing temperature of water.

One particular problem arises in circulating cooling air from an evaporator in the ice maker compartment to the ice tray wherein the ice cubes are formed. Over time, relatively warmer moisture in the ice maker collects on the relatively colder evaporator and on components downstream of the evaporator and freezes. The ice maker is designed to periodically perform a defrost cycle to melt the ice and/or frost and conduct the water away from the evaporator. In some instances, high humidity in the surrounding environment may cause excessive amounts of ice to build up on the evaporator and, in some instances, on the fan used to convey the cooling air through the ice maker. When ice builds up on the fan, the fan becomes unbalanced and/or inoperable and the ice maker ceases to make ice cubes. At this time, the problem cannot be remedied by a normal defrost cycle. Instead, a service person must manually clean away the ice build-up. As can be appreciated, this results in downtime, inconvenience and cost to the user and/or the manufacturer.

Accordingly, there is a need in the art for a refrigerator including an ice maker disposed within a fresh food compartment of the refrigerator in which the accumulation of ice/frost on the fan of the ice maker can be prevented, or at least minimized.

There is also a need in the art for a handle-operated door lock, and/or an apparatus for determining the height of ice pieces in an ice bin of the ice maker.

BRIEF SUMMARY OF THE INVENTION

In accordance with one aspect, there is provided a refrigeration appliance that includes a fresh food compartment for storing food items in a refrigerated environment having a target temperature above zero degrees Centigrade. An ice maker is disposed within the fresh food compartment for producing and storing ice pieces. The ice maker includes an ice tray for forming ice pieces. An ice bin receives and stores the ice pieces produced by the ice tray. An air handler assembly conveys cooling air through the ice tray and the ice bin. An evaporator is provided for cooling air conveyed through the ice tray and the ice bin. The air handler assembly includes a fan that conveys the cooled air. An insulated air duct is disposed between the evaporator and the fan for preventing the migration of ice from the evaporator to the fan. The insulated duct has an opening extending from an end adjacent the evaporator to an end adjacent the fan. A lower inner wall of the air duct has a first ramped portion on the end adjacent the evaporator.

In accordance with another aspect, there is provided an ice maker for freezing water into ice pieces. The ice maker includes an ice tray for forming ice pieces. An ice bin receives and stores ice pieces produced by the ice tray. An evaporator is provided for cooling air conveyed through the ice tray and the ice bin. An air handler assembly conveys cooling air through the ice tray and the ice bin. The air handler assembly includes a fan that conveys the cooling air. An insulated air duct is disposed between the evaporator and the fan for preventing the migration of ice from the evaporator to the fan. The insulated duct has an opening extending from an end adjacent the evaporator to an end adjacent the fan. A lower inner wall of the air duct has a first ramped portion on the end adjacent the evaporator.

In accordance with yet another aspect, there is provided an ice maker for freezing water into ice pieces. The ice maker includes an ice tray for forming ice pieces. An ice bin is provided for receiving and storing ice pieces produced by the ice tray. A sensor assembly is positioned to detect a level of ice in the ice bin. The sensor assembly includes an emitter for sending photons along a predetermined path. A receiver is provided for detecting the photons when the photons are reflected off an object disposed in the predetermined path. A controller is programmed to measure a duration of time between the emitter sending the photons along the predetermined path and the receiver detecting the photons to determine at least one of a height of the ice pieces in the ice bin and the presence/absence of the ice bin in the ice maker based on input from the emitter and the receiver.

DESCRIPTION OF EXAMPLE EMBODIMENTS

Figure 1:
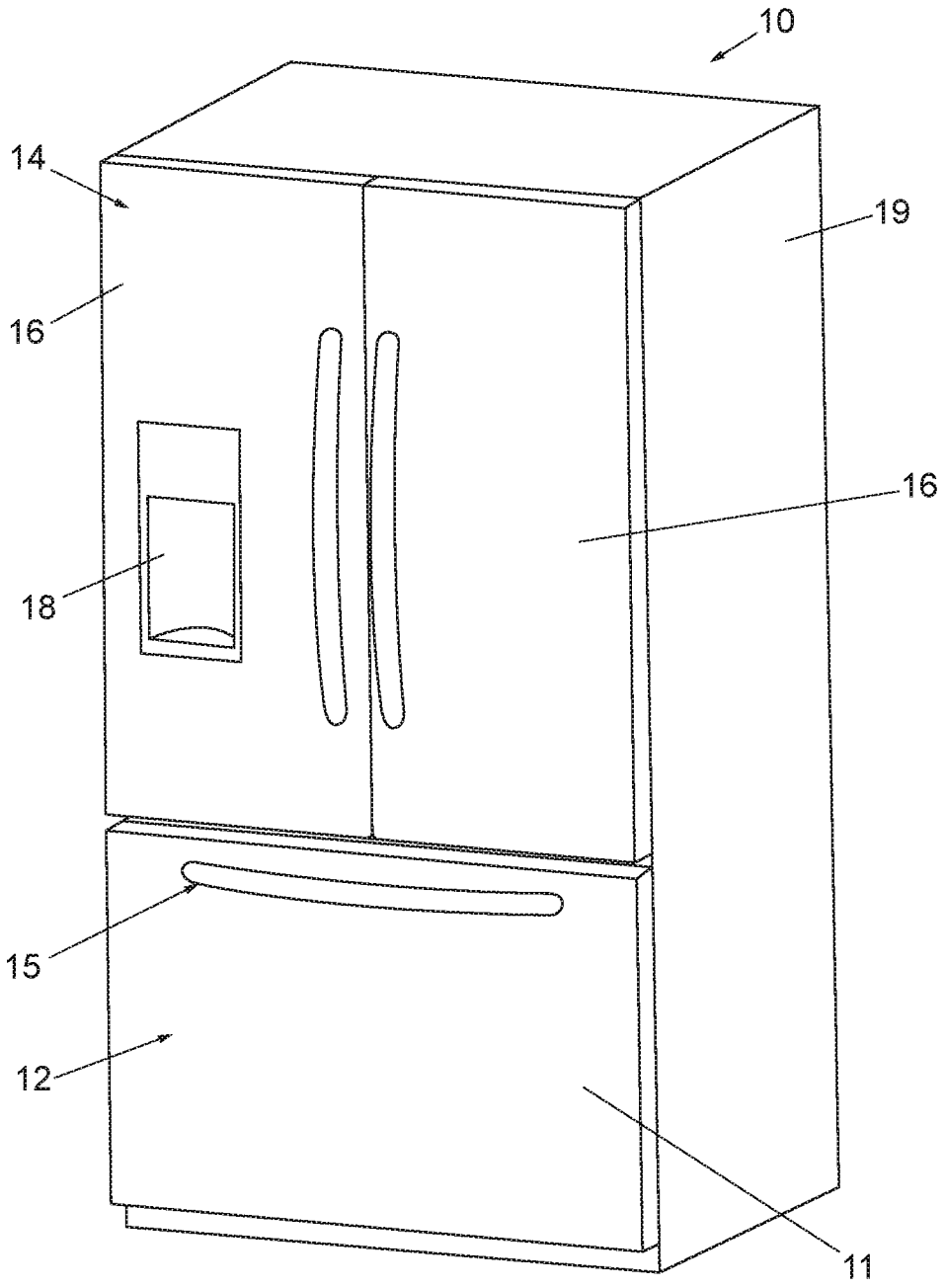
FIG. 1 is a front perspective view of a household French Door Bottom Mount showing doors of the refrigerator in a closed position.
Figure 2:
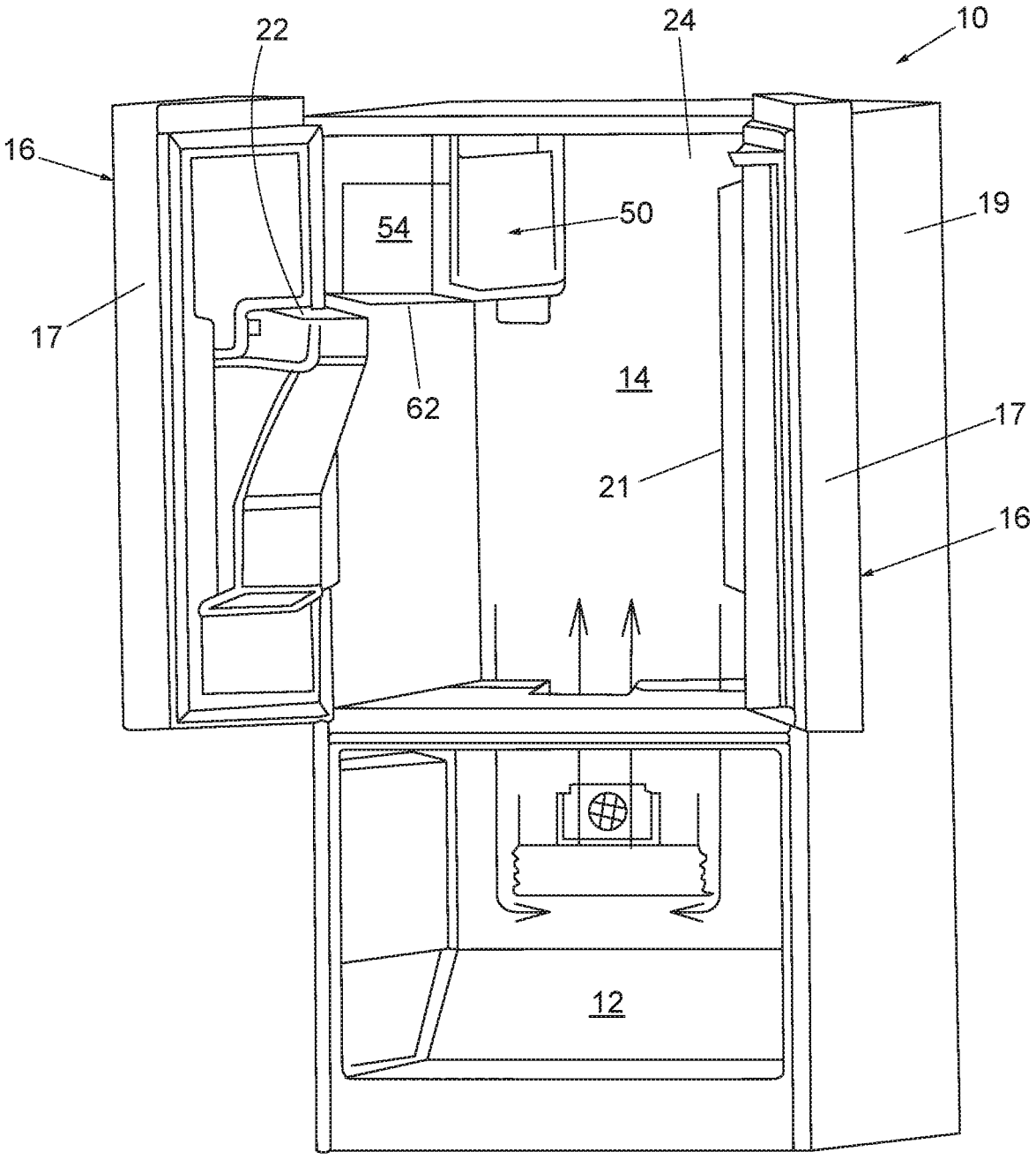
FIG. 2 is a front perspective view of the refrigerator of FIG. 1 showing the doors in an open position and an ice maker in a fresh food compartment.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh-food compartment 14 disposed vertically above a freezer compartment 12. However, the refrigerator 10 can have any desired configuration including at least a fresh food compartment 14 and an ice maker 50 (FIG. 2), such as a top mount refrigerator (freezer disposed above the fresh food compartment), a side-by-side refrigerator (fresh food compartment is laterally next to the freezer compartment), a standalone refrigerator or freezer, etc.

One or more doors 16 shown in FIG. 1 are pivotally coupled to a cabinet 19 of the refrigerator 10 to restrict and grant access to the fresh food compartment 14. The door 16 can include a single door that spans the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14. For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotally coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation, and forms an angle other than parallel relative to the door 16 when the center mullion 21 is in the second orientation. The seal and the externally-exposed surface of the mullion 21 cooperate approximately midway between the lateral sides of the fresh food compartment 14.

A dispenser 18 (FIG. 1) for dispensing at least ice pieces, and optionally water, can be provided on an exterior of one of the doors 16 that restricts access to the fresh food compartment 14. The dispenser 18 includes a lever, switch, proximity sensor or other device that a user can interact with to cause frozen ice pieces to be dispensed from an ice bin 54 (FIG. 2) of the ice maker 50 disposed within the fresh food compartment 14. Ice pieces from the ice bin 54 can be delivered to the dispenser 18 via an ice chute 22 (FIG. 2), which extends at least partially through the door 16 between the dispenser 18 and the ice bin 54.

Referring to FIG. 1, the freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10.

The refrigerator 10 includes an interior liner 24 (FIG. 2) that defines the fresh food compartment 14. The fresh food compartment 14 is located in the upper portion of the refrigerator 10 in this example and serves to minimize spoiling of articles of food stored therein. The fresh food compartment 14 accomplishes this by maintaining the temperature in the fresh food compartment 14 at a cool temperature that is typically less than an ambient temperature of the refrigerator 10, but somewhat above 0° C., so as not to freeze the articles of food in the fresh food compartment 14. According to some embodiments, cool air from which thermal energy has been removed by the freezer evaporator can also be blown into the fresh food compartment 14 to maintain the temperature therein at a cool temperature that is greater than 0° C. For alternate embodiments, a separate fresh food evaporator can optionally be dedicated to separately maintaining the temperature within the fresh food compartment 14 independent of the freezer compartment 12. According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

Figure 3:
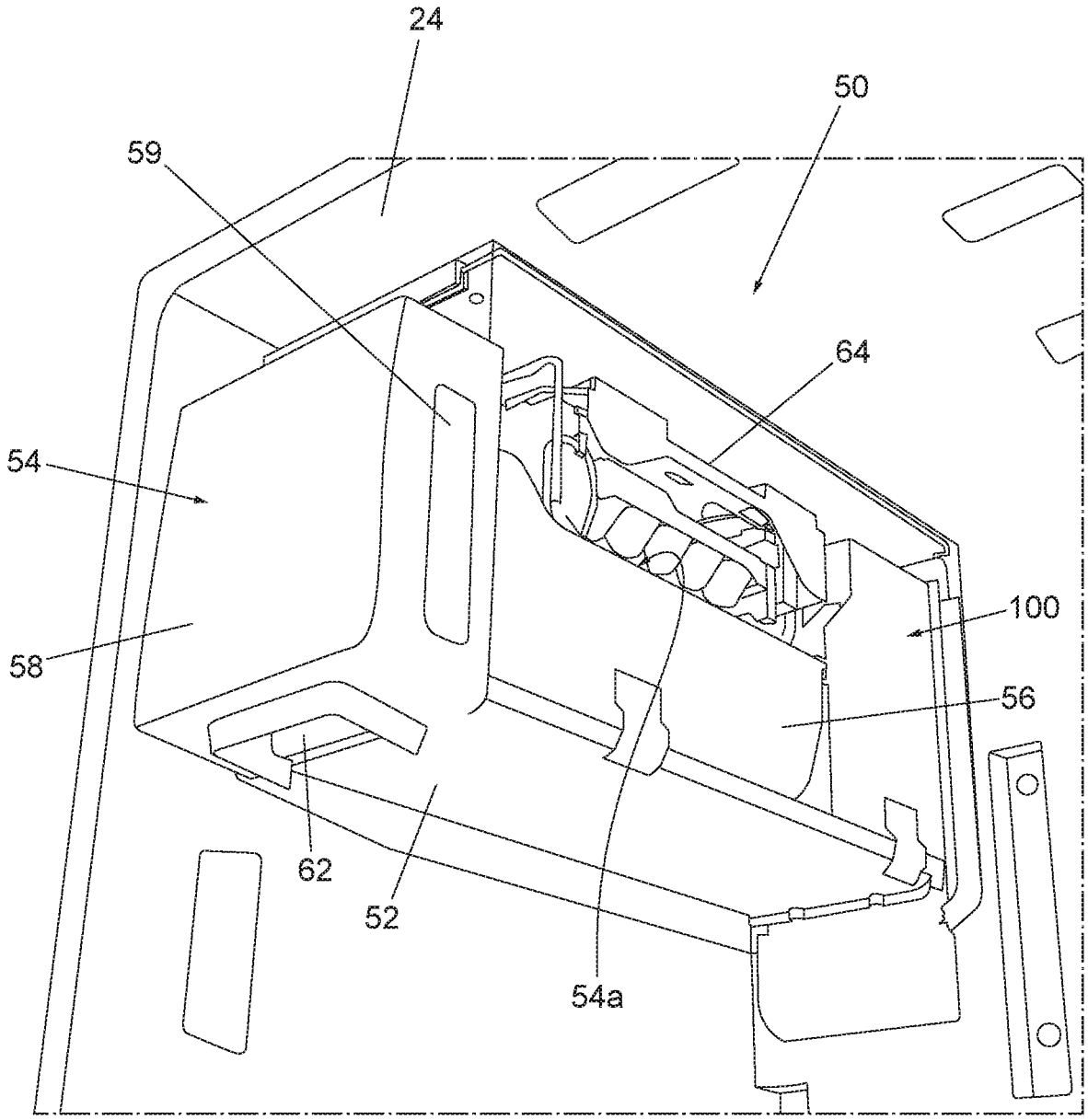
FIG. 3 is a side perspective view of an ice maker with a side wall of a frame of the ice maker removed.

An illustrative embodiment of the ice maker 50 is shown in FIG. 3. In general, the ice maker 50 includes a frame 52, an ice tray 64, an ice bin 54 that stores ice pieces made by the ice tray 64, an evaporator/defrost assembly 170 provides cooled air, and an air handler assembly 100 that circulates the cooled air to the ice tray 64 and the ice bin 54. The ice maker 50 is secured within the fresh food compartment 14 using any suitable fastener. The frame 52 is generally rectangular in shape for receiving the ice bin 54. The frame 52 includes insulated walls for thermally isolating the ice maker 50 from the fresh food compartment 14. A plurality of fasteners (not shown) may be used for securing the frame 52 of the ice maker 50 within the fresh food compartment 14 of the refrigerator 10.

Referring now to FIG. 3, for clarity the ice maker 50 is shown with a side wall of the frame 52 removed; normally, the ice maker 50 would be enclosed by insulated walls. The ice bin 54 includes a housing 56 having an open, front end and an open top. A front cover 58 is secured to the front end of the housing 56 to enclose the front end of the housing 56. When secured together to form the ice bin 54, the housing 56 and the front cover 58 define an internal cavity 54*a* of the ice bin 54 used to store the ice pieces made by the ice tray 64. The front cover 58 may be secured to the housing 56 by mechanical fasteners that can be removed using a suitable tool, examples of which include screws, nuts and bolts, or any suitable friction fitting possibly including a system of tabs allowing removal of the front cover 58 from the housing 56 by hand and without tools. Alternatively, the front cover 58 is non-removably secured in place on the housing 56 using methods such as, but not limited to, adhesives, welding, non-removable fasteners, etc. In various other examples, a recess 59 is formed in a side of the front cover 58 to define a handle that may be used by a user for ease in removing the ice bin 54 from the ice maker 50. An aperture 62 is formed in a bottom of the front cover 58. A rotatable auger (not shown) can extend along a length of the ice bin 54. As the auger rotates, ice pieces in the ice bin 54 are urged ice towards the aperture 62 wherein an ice crusher (not shown) is disposed. The ice crusher is provided for crushing the ice pieces conveyed thereto, when a user requests crushed ice. The augur can optionally be automatically activated and rotated by an auger motor assembly 140 (FIG. 4) of the air handler assembly 100, as described in detail below. The aperture 62 is aligned with the ice chute 22 (FIG. 2) when the door 16 is closed. This alignment allows for the auger to push the frozen ice pieces stored in the ice bin 54 into the ice chute 22 to be dispensed by the dispenser 18.

Keeping with FIG. 3, the ice tray 64 is positioned in an upper portion of the ice maker 50. In one example, the ice tray 64 is a twist-tray type, in which the ice tray 64 is rotated upside down and twisted along its longitudinal axis to thereby break the frozen ice pieces free from the ice reservoirs of the ice tray 64 where they fall into the internal cavity 54*a* of the ice bin 54 located below the ice tray 64. Still, a conventional metal water tray with a plurality of sweeper-arms and a harvest heater for partially melting the ice pieces, or even other types of ice maker assemblies like the finger-evaporator type, could also be utilized.

Figure 4:
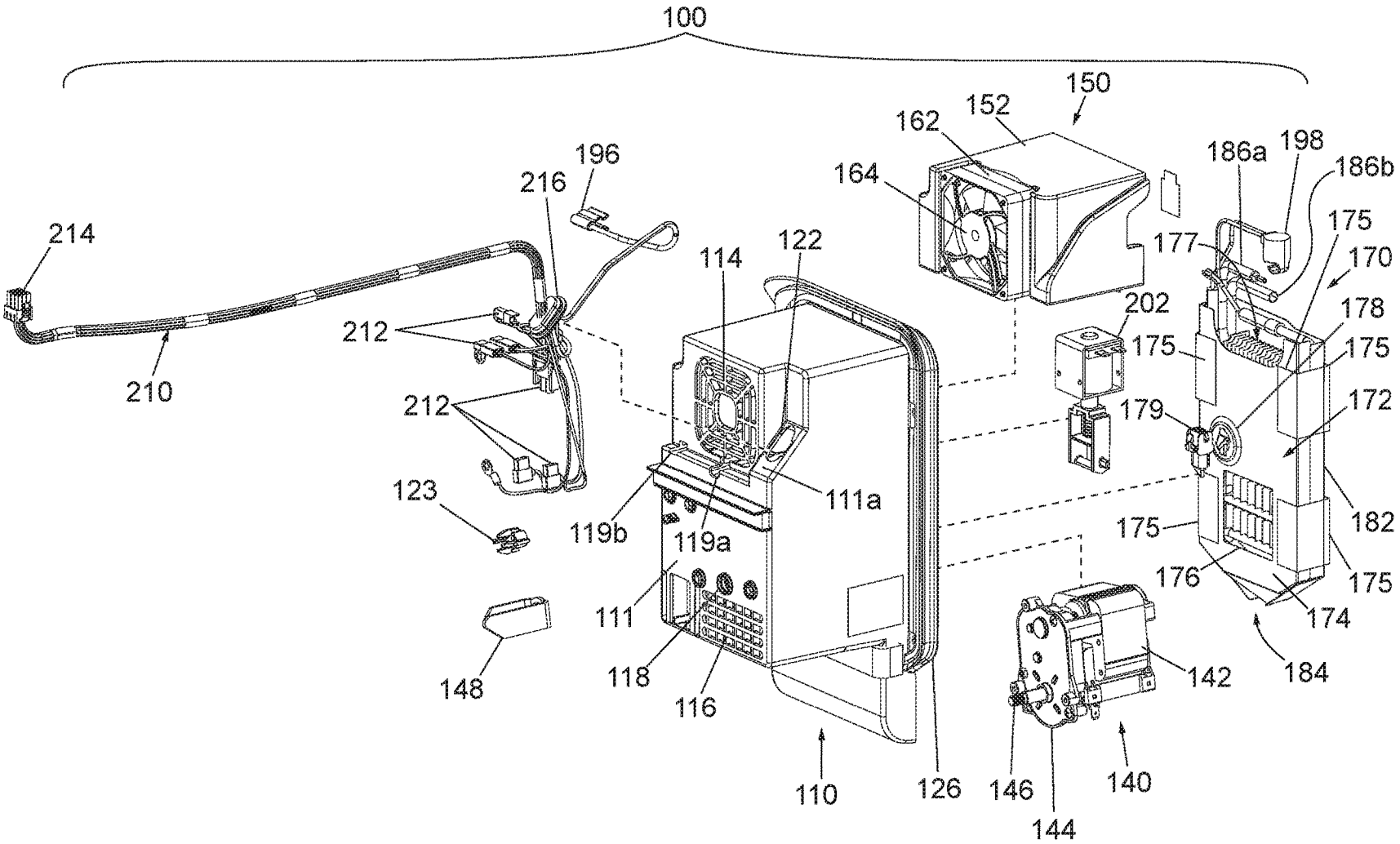
FIG. 4 is a front exploded view of an air handler assembly of the ice maker shown in FIG. 3.
Figure 5:
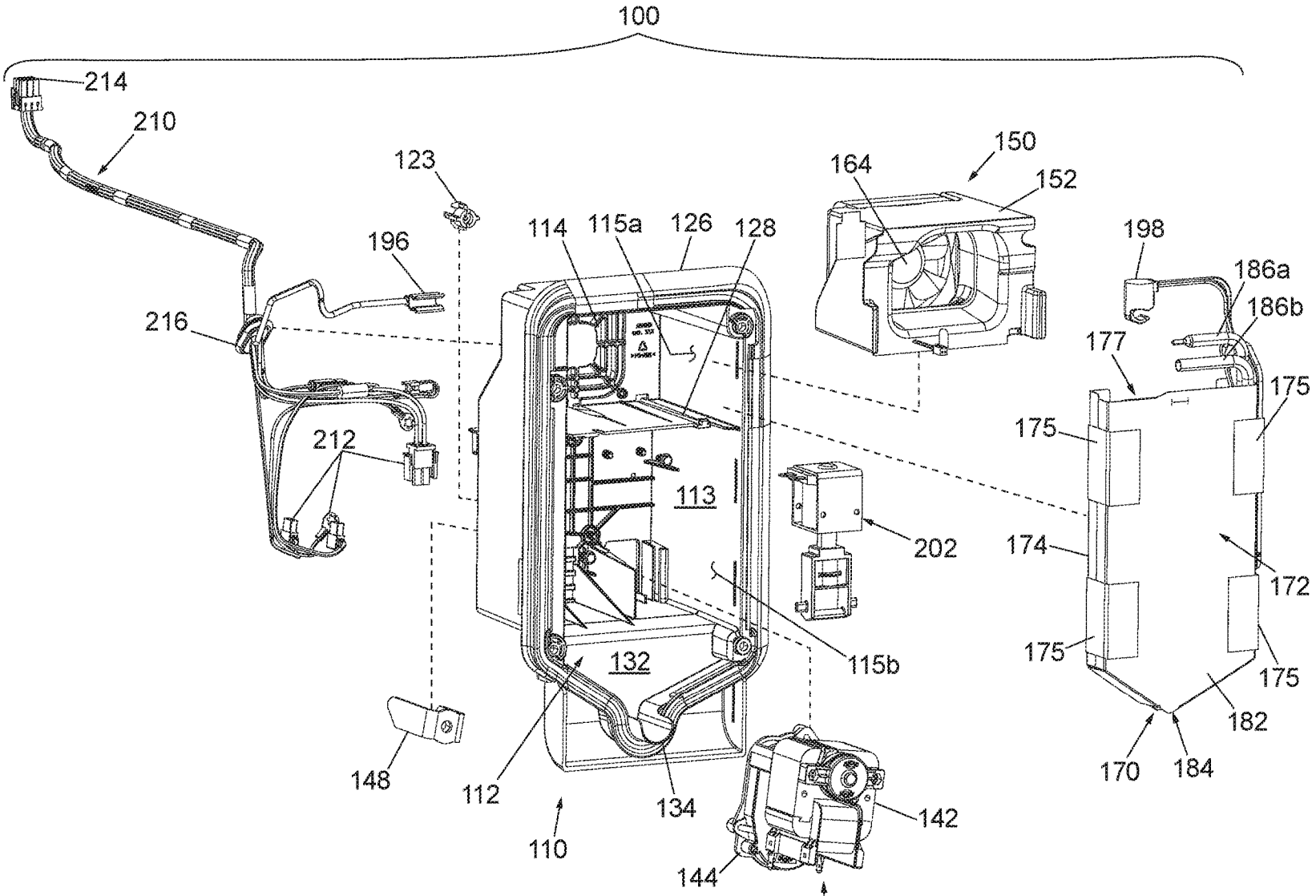
FIG. 5 is a rear exploded view of the air handler assembly shown in FIG. 4.

The air handler assembly 100, shown in FIGS. 3-5, is disposed in a rear of the ice maker 50. In general, the air handler assembly 100 includes a housing 110, the auger motor assembly 140, an evaporator fan assembly 150, and a solenoid 202. The air handler assembly 100 is provided for circulating cooling air over the ice tray 64 and through the ice bin 54. It is contemplated that the auger motor assembly 140 could be separately provided and/or controlled. A plurality of fasteners (not shown) may be provided for securing the air handler assembly 100 to the liner 24 of the fresh food compartment 14.

Referring now to FIGS. 4 and 5, the housing 110 is a generally box-shaped element having a front face 111, an open back 112 and an interior cavity 113. An upper opening 114 is formed in an upper portion of the front face 111 of the housing 110. A lower opening 116 is formed in a lower portion of the front face 111. The upper opening 114 defines an outlet for exhausting cool air from the air handler assembly 100 and the lower opening 116 defines an inlet for drawing air into the air handler assembly 100.

In the embodiment shown, the upper opening 114 and the lower opening 116 are divided into a plurality of openings to prevent large debris from passing into/out of the housing 110. The openings can also be appropriately sized to prevent a user from inserting a finger or other similarly sized object into the openings 114, 116. It is also contemplated that a separate piece, e.g., a screen or a grill can be placed over the openings 114, 116 or molded into the housing 110 to define the plurality of openings.

As shown in FIG. 4, a first groove or slot 119*a* and a second groove or slot 119*b* extend through the front face 111 of the housing 110. The first groove 119*a* is positioned below the lower opening 116 and the second groove 119*b* is offset from the first groove 119*a*. The first groove 119*a* provides fluid communication with the interior cavity 113 of the housing 110 for draining water from the housing 110, as described in detail below. The second groove 119*b* is an additional groove that is formed during a molding process of the housing 110. It is contemplated that the second groove 119*b* can be used as an additional drain groove.

A circular opening 118 is formed in the front face 111 of the housing 110 at a location above the lower opening 116. The circular opening 118 is dimensioned and positioned as described in detail below. A portion 111*a* of the front face 111 of the housing 110 is sloped and includes an oblong opening 122 therein. The oblong opening 122 is dimensioned as described in detail below.

A latch pin 123 is optionally attached to the front face of the housing 110. The latch pin 123 is provided to resist the forces and vibrations resulting from operation of the auger and to hold the ice bin 54 in place. The latch pin 123 is described in more detail in U.S. Pat. No. 9,234,690 (issued on Jan. 12, 2016) incorporated in its entirety herein by reference. Alternatively, the latch pin 123 could be coupled to or formed with the ice bin 54 and may releasably latch into a suitable hole in the front face of the housing 110.

As shown in FIG. 5, an optional gasket 126 is disposed around an outer periphery of the open back 112 of the housing 110. In one embodiment, the gasket 126 is a separate component that is dimensioned to be positioned on a flange (not shown) for defining a seal between the housing 110 and the liner 24 (FIG. 3) of the refrigerator 10. It is contemplated that the housing 110 and the gasket 126 may be formed as an integral unit using a two shot molding process wherein the housing 110 is made of a first rigid material and the gasket 126 is made from a flexible material. The housing 110 may be made of a plastic material, such as ABS and the gasket 126 may be made of a flexible material, such as rubber.

A lower, rear portion of the housing 110 is sloped to define a sump or fluid collection portion 132 of the housing 110. A U-shaped channel 134 extends from the sump 132. The channel 134 is attachable to a drain line (not shown). As described in detail below, fluid that collects within the sump 132 exits through the channel 134 and away from the air handler assembly 100 during a defrost cycle.

A partition 128 divides the interior cavity 113 of the housing 110 into an upper cavity 115*a* and a lower cavity 115*b*. The lower cavity 115*b* is dimensioned to receive the auger motor assembly 140. It is contemplated that the upper cavity 115*a* and the lower cavity 115*b* include a plurality of ribs for properly positioning components in the housing 110 and a plurality of holes for securing components to the housing 110.

As shown in FIGS. 4 and 5, the auger motor assembly 140 includes a motor 142 attached to a gear box 144. A drive shaft 146 (FIG. 4) extends out of the gear box 144 for connecting to and actuating the auger disposed in the ice bin 54 (FIG. 3). The motor 142 is connected to and driven by a controller (not shown) of the refrigerator 10. The drive shaft 146 is dimensioned to attach to a coupling 148. The coupling 148 is dimensioned to engage a mating coupling (not shown) in the back of the ice bin 54 when the ice bin 54 is fully inserted into the ice maker 50. The mating coupling, in turn, is connected to the auger inside the ice bin 54. When the motor 142 is energized the drive shaft 146 of the motor 142 rotates the coupling 148 which, in turn causes the auger within the ice bin 54 to rotate. As discussed in detail above, the rotation of the auger causes ice pieces within the ice bin 54 to be pushed into the ice chute 22 and dispensed by the dispenser 18.

Figure 6:
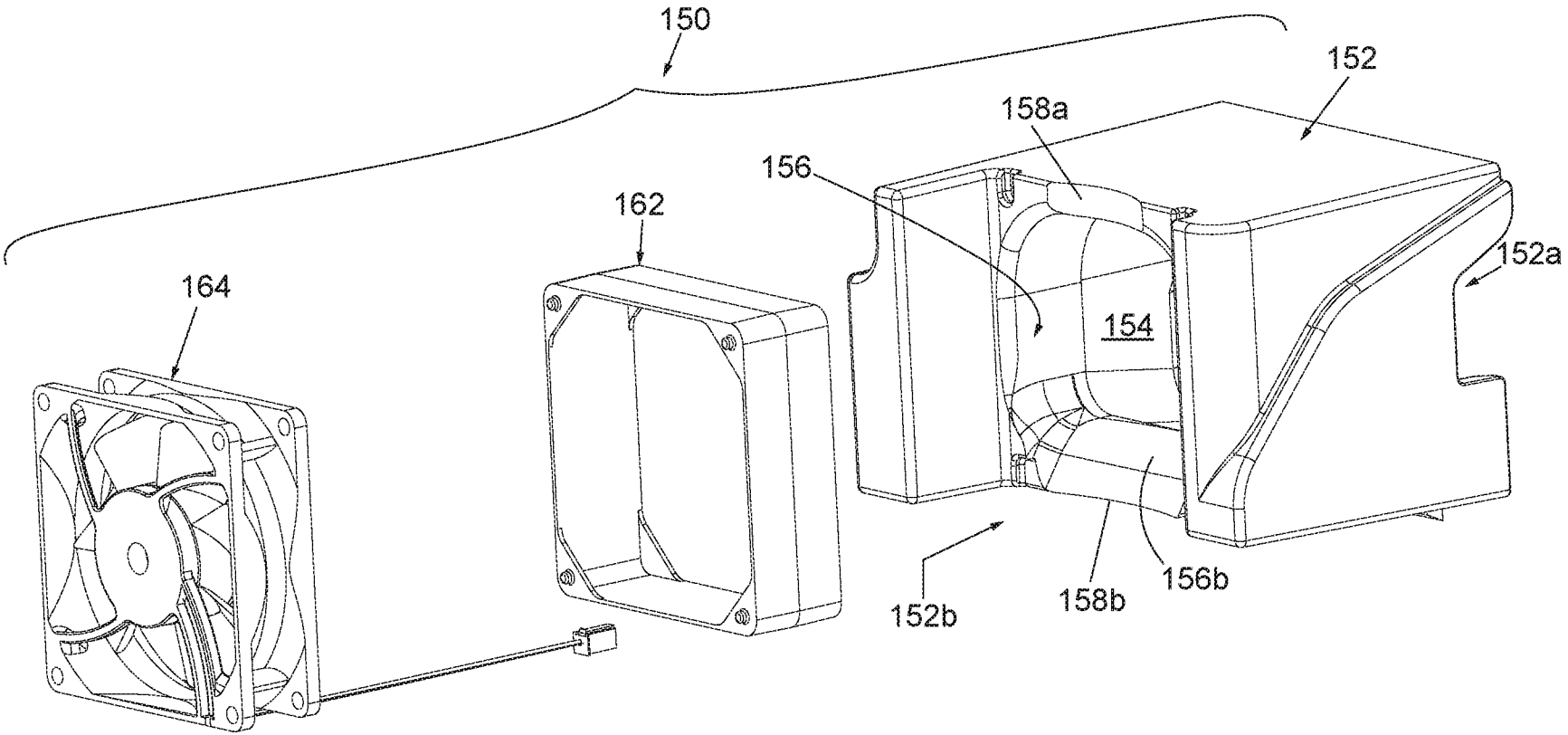
FIG. 6 is a front exploded view of an evaporator fan assembly of the air handler shown in FIG. 4.
Figure 7:
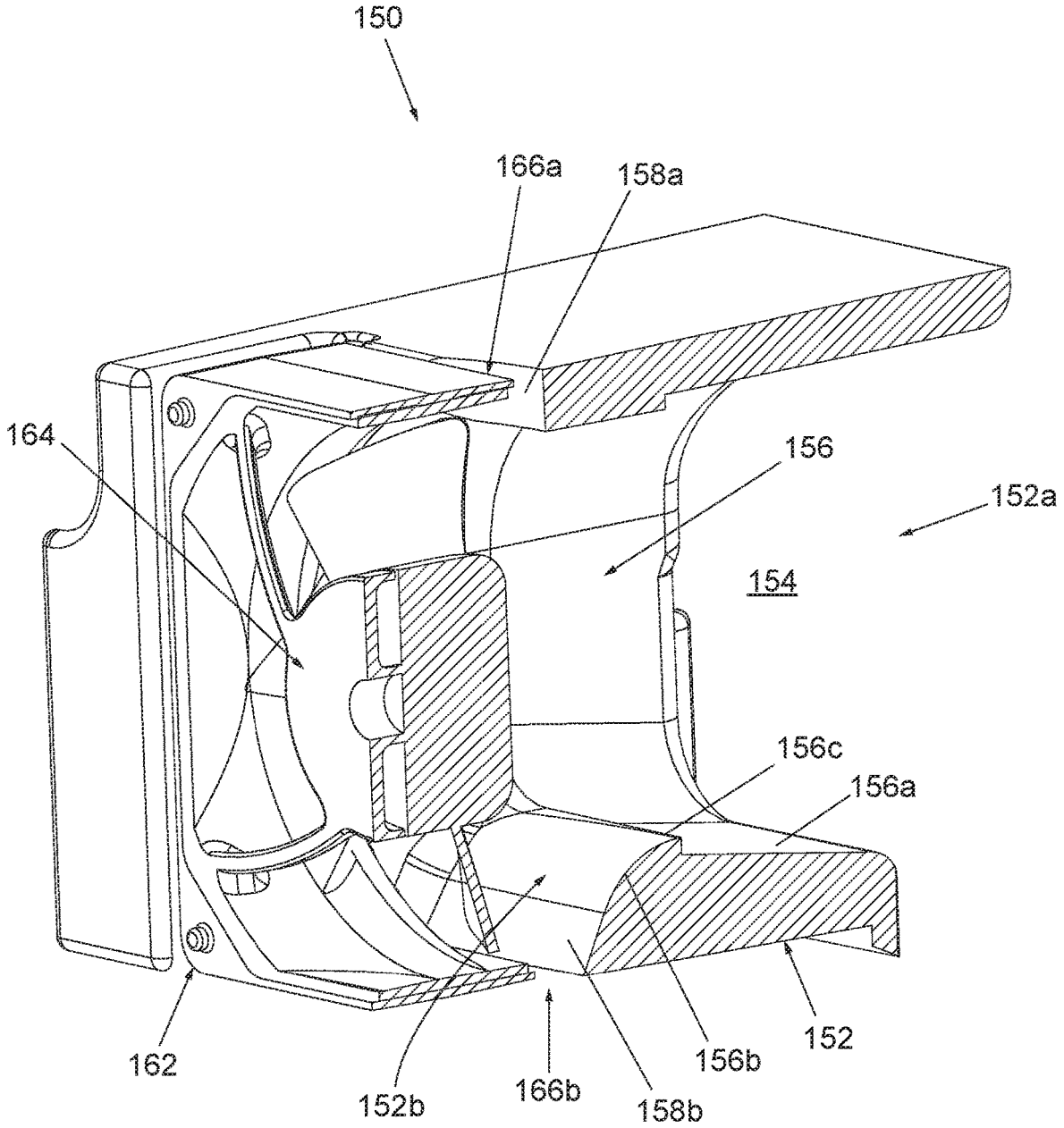
FIG. 7 is a section view of the evaporator fan assembly shown in FIG. 6.

As shown in FIGS. 4 and 5, the evaporator fan assembly 150 is dimensioned to be received into the upper cavity 115*a* of the housing 110. Referring now to FIGS. 6 and 7, the evaporator fan assembly 150 includes an air duct 152, an optional fan grommet 162 and a fan 164. An opening 154 extends through the air duct 152 from a first end 152*a* to a second end 152*b* of the air duct 152.

As shown in FIGS. 6-7, an interior surface 156 of the air duct 152 is contoured to define a first downward ramped portion 156*a* near the first end 152*a* and a second downward ramped portion 156*b* near the second end 152*b*. The first ramped portion 156*a* and the second ramped portion 156*b* each slope in a downward direction from a central portion 156*c* of the air duct 152. Alternatively, the first ramped portion 156*a* and the second ramped portion 156*b* can be referred to as "upward" ramped portions that slope in an upward direction from the first end 152*a* of the air duct 152, i.e., the first ramped portion 156*a* or in an upward direction from the second end 152*b* of the air duct 152, i.e., the second ramped portion 156*b*. Although illustrated as a sharp step, the central portion 156*c* is contemplated to be a point or area that defines the transition between the first and second ramped portions 156*a*-156*b*. It is contemplated that the slope of the first ramped portion 156*a* is less than the slope of the second ramped portion 156*b*. In addition, the length of the first ramped portion 156*a* is greater than a length of the second ramped portion 156*b*. The first ramped portion 156*a* is designed to aid in draining water away from the fan 164, as described in detail below. The second ramped portion 156*b* is designed to minimize air flow resistance to the fan 164, although optionally it may also be used to drain water away from the fan 164.

In the embodiment shown, the first ramped portion 156*a* is a downwardly sloped planar surface and the second ramped portion 156*b* is a downwardly sloped curved surface. It is contemplated that the first ramped portion 156*a* could be a downwardly curved surface and/or the second ramped portion 156*b* could be a downwardly sloped planar surface. In the embodiment shown, the slopes of the first ramped portion 156*a* and the second ramped portion 156*b* are continuous, i.e., no steps and no points where the slope abruptly changes. It is contemplated that at least one of the first ramped portion 156*a* and the second ramped portion 156*b* may include at least one step (not shown) or a slope that abruptly changes at one or more discrete locations (not shown) along the first ramped portion 156*a* and/or the second ramped portion 156*b*.

It is also contemplated that the second downward ramped portion 156*b* can a substantially vertical surface. In the embodiment shown, the first downward ramped portion 156*a* has a low point at the first end 152*a*. It is contemplated that the low point of the first downward ramped portion 156*a* could be at a location spaced from the first end 152*a*.

The second end 152*b* of the air duct 152 includes an upper notched portion 158*a* and a lower notched portion 158*b* on the leading edge of opening 154. The upper notched portion 158*a* and the lower notched portion 158*b* are positioned to be adjacent to a side of the fan grommet 162.

It is contemplated that the air duct 152 can be made from an insulating material, such as a rigid EPS foam, plastic, rubber, or the like. The air duct 152 can be monolithic or assembled of multiple parts. It is also contemplated that the air duct 152 can be between about 2 inches and about 5 inches in length such that the fan 164 is positioned at least about 2 to about 5 inches from the evaporator/defrost assembly 170 of the ice maker 50. It is also contemplated that the air duct 152 may be about 3 inches in length.

The fan grommet 162 is dimensioned to be placed around the outer side walls of the fan 164. Both the fan grommet 162 and the fan 164 can be secured to the second end 152*b* of the air duct 152 by slightly flexing the second end 152*b* of the air duct 152 around the fan grommet 162 and the fan 164. It is also contemplated that the fan grommet 162 and the fan 164 can be inserted into a slot formed on the second end 152*b* of the air duct 152 and/or fasteners (not shown), such as screws can be used to secure the fan grommet 162 and the fan 164 to the air duct 152. The fan grommet 162 can be made from an elastic material to dampen the transmission of vibrations from the fan 164 to the air duct 152 during operation. As shown in FIG. 7, the upper notched portion 158*a* and the side of the fan grommet 162 define an upper gap 166*a* between the air duct 152 and the fan 164. Similarly, the lower notched portion 158*b* and the side of the fan grommet 162 define a lower gap 166*b* between the air duct and the fan 164. As explained in detail below, the upper and lower gaps 166*a*, 166*b* help to prevent ice on the air duct 152 for migrating or expanding to the fan 164. The lower gap 166*b* also helps to drain water from the air duct 152 during a defrost cycle.

In the embodiment shown, the air duct 152 includes the upper notched portion 158*a* and the lower notched portion 158*b*. It is also contemplated that, instead of notching the air duct 152, the corresponding side of the fan grommet 162 may be notched. It is also contemplated that one or more holes can be formed in the bottom of the air duct 152 and/or the fan grommet 162 and positioned to be in registry with the first groove or slot 119*a* in the housing 110 when the evaporator fan assembly 150 is positioned in the housing 110, as described in detail below.

Figure 8:
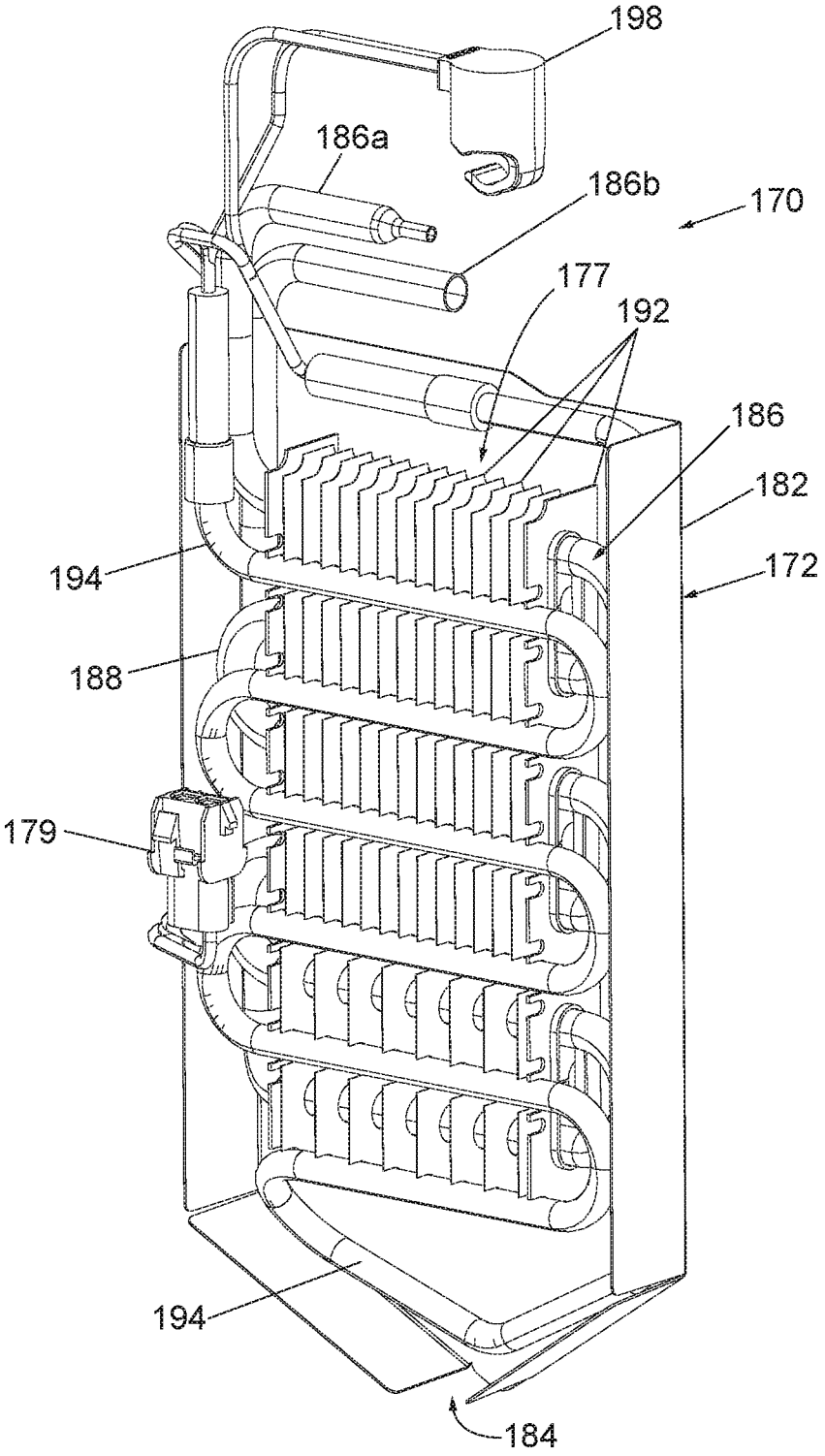
FIG. 8 is a front perspective view of an evaporator/defrost assembly of the air handler assembly shown in FIG. 4 with a front sleeve removed.

As shown in FIGS. 4 and 5, the air handler assembly 100 is dimensioned such that the open back 112 of the housing 110 can receive the evaporator/defrost assembly 170. The evaporator/defrost assembly 170 includes an evaporator 186 (FIG. 8) and a defrost heater 194 (FIG. 8). The evaporator/defrost assembly 170 can be attached to the liner 24 of the fresh food compartment 14 (not shown).

In the embodiment shown, the housing 172 includes a first sleeve plate 174 and a second sleeve plate 182. The first sleeve plate 174 and the second sleeve plate 182 are formed to define an upper rectangular portion of the housing 172 and a lower triangular portion of the housing 172. In the embodiment shown, individual pieces of tape 175 are provided for securing the first sleeve plate 174 to the second sleeve plate 182. It is also contemplated that the first sleeve plate 174 and the second sleeve plate 182 can be secured together using devices such as, but not limited to, fasteners, adhesives, welds, clips, snap-fit features and interference fits. It is also contemplated that one of the first sleeve plate 174 and the second sleeve plate 182 can be slightly larger or wider than the other sleeve plate 174, 182 such that one of the first sleeve plate 174 and the second sleeve plate 182 can be nested inside of the other sleeve plate 174, 182. It is contemplated that the first and second sleeve plates 174, 182 may be made of a metal, such as aluminum, or any other material that can function to evenly distribute heat from the defrost heater 194 into the housing 172, as described below.

A rectangular opening 176 (FIG. 4) extends through a face of the first sleeve plate 174 and defines an air inlet for allowing air to enter the housing 172 of the assembly 170. The upper ends of the first and second sleeve plates 174, 182 are spaced-apart to define an opening 177 of the housing 172. The opening 177 defines an air outlet of the housing 172. An opening 184 is formed in the lower portion of the housing 172 to define a drain opening of the housing 172. It is also contemplated that the housing 172 can be made of a single piece, for example, a duct or a plurality of pieces that are joined together to form the housing 172.

Referring now to FIG. 8, wherein the first sleeve plate 174 is removed to show additional components of the assembly 170. The evaporator 186 is disposed in the rectangular upper portion of the housing 172. The evaporator 186 is a conventional evaporator that is used to draw heat from an air stream passing over the evaporator 186. The evaporator 186 includes an inlet line 186*a* that is connected to a condenser of a cooling system (not shown) and an outlet line 186*b* that is connected to a compressor of the cooling system. In general, the evaporator 186 includes a serpentine-shaped conduit 188 that passes through a plurality of fins 192. The fins 192 are designed to aid in the transmission of heat from the air stream to the fluid passing through the conduit 188 of the evaporator 186. A plurality of slots are formed in the fins 192 to receive the defrost heater 194.

The defrost heater 194 is a serpentine-shaped element that is disposed to one side of the evaporator 186. The defrost heater 194 is designed to apply heat to the evaporator 186 during a defrost cycle to metal ice/frost that may have accumulated on the evaporator 186. A plug mount 178 (FIG. 4) is formed in the first sleeve plate 174 and is dimensioned to receive a plug 179 of the defrost heater 194. The plug 179 is configured to connect to a corresponding connector 212 on a wiring harness 210 (FIG. 4) for allowing electrical power to be supplied to the defrost heater 194, as needed.

A safety bimetal switch (thermostat) 198 is attachable to the outlet line 186*b* of the evaporator 186. The bimetal switch 198 is connected in series with the defrost heater 194 for interrupting power to the defrost heater 194 when the bimetal switch 198 reaches a predetermined temperature during the defrost cycle. The bimetal switch 198, in general, is a switch that is designed to physically open a contact when the switch 198 reaches the predetermined temperature. The switch 198 acts as a safety switch to prevent the defrost heater 194 from heating the evaporator 186 to a temperature in excess of the predetermined temperature.

Referring to FIGS. 4 and 5, the solenoid 202 is disposed in front of the evaporator/defrost assembly 170. The solenoid 202 is provided for moving a door (not shown) of the ice crusher at the end of the ice bin 54 (FIG. 2) between a first position and a second position. The door is designed such that the ice pieces conveyed to the ice crusher exit the ice crusher as whole pieces when the door is in the first position. The ice pieces are crushed by the ice crusher when the door is in the second position. The dispenser 18 (FIG. 1) of the refrigerator 10 includes a selector (not shown) that allows a user to select whether the ice pieces exiting the dispenser 18 are whole or crushed. The selector may be a button, a lever or an equivalent input device for allowing the user to select whole or crushed ice pieces.

The wiring harness 210 can be installed in the housing 110 and includes a plurality of connectors 212 that are individually configured for connecting to the motor 142, the fan 164, the plug 179 of the defrost heater 194 and the solenoid 202. A thermistor 196 is attached to one end of the wiring harness 210. The thermistor 196 is attachable to the inlet line 186*a* of the evaporator 186 for monitoring a temperature of the evaporator 186. Based on the temperature measured by the thermistor 196, a controller controls a defrost time of the defrost cycle. In particular, the controller monitors the temperature measured by the thermistor 196 and stops the defrost cycle when a predetermined temperature is reached.

An opposite end of the wiring harness 210 includes a plug 214 that is connectable to the controller for allowing the controller to control the operation of and/or receive signals from a respective component. The wiring harness 210 may also include a ground strap for grounding the motor 142 and the solenoid 202. The wiring harness 210 extends through the oblong opening 122 (FIG. 4) in the housing 110. A grommet 216 on the wiring harness 210 is dimensioned to be inserted into the oblong opening 122 to provide a seal and to protect the wires of the wiring harness 210.

The air handler assembly 100 is assembled by feeding the wiring harness 210 through the oblong opening 122 in the housing 110 so that the connectors 212 are disposed within the interior cavity 113 of the housing 110 and the plug 214 is disposed outside of the housing 110. The connectors 212 of the wiring harness 210 are positioned within the housing 110 to connect to the respective components of the air handler assembly 100. The plug 214 on the opposite end of the wiring harness 210 is connected to the controller.

Figure 9:
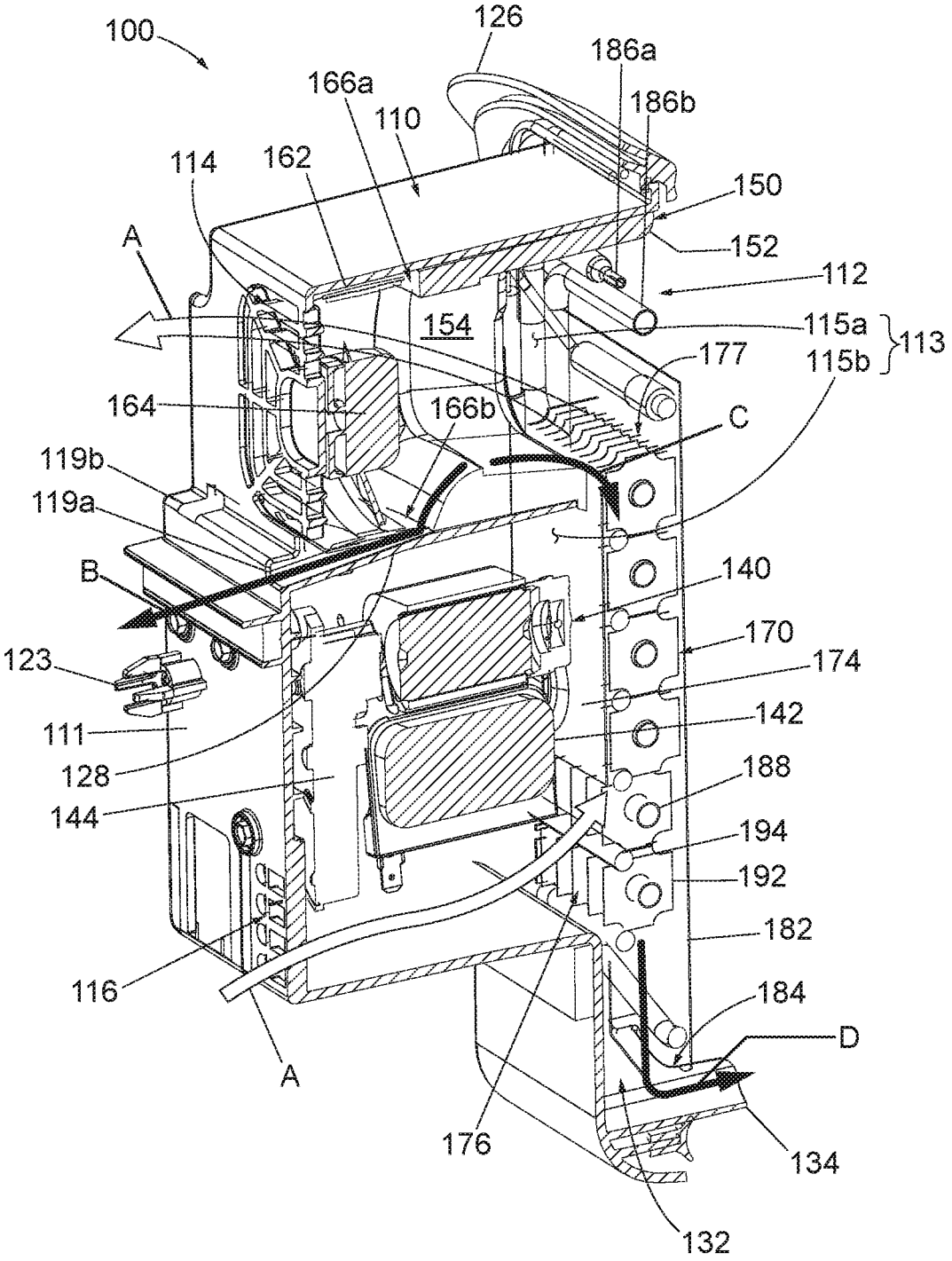
FIG. 9 is a section view of the air handler assembly shown in FIG. 4 showing air flow paths and water drainage paths through the air handler assembly.

Referring now to FIG. 9, the evaporator fan assembly 150 is positioned in the upper cavity 115*a* of the housing 110 above the partition 128. In particular, the evaporator fan assembly 150 is positioned in the housing 110 such that the fan 164 aligns with and is in registry with the upper opening 114 in the front face 111 of the housing 110. Fasteners (not shown) may be used to secure the evaporator fan assembly 150 into the housing 110.

The auger motor assembly 140 is positioned in the lower cavity 115*b* of the housing 110. In particular, the auger motor assembly 140 is positioned within the housing 110 such that the drive shaft 146 (FIGS. 4 and 5) of the gear box 144 extends through the opening 118 (FIGS. 4 and 5) in the front face 111 of the housing 110 and the coupling 148 (FIGS. 4 and 5) is attached to the end of the drive shaft 146. Fasteners (not shown) can be used to secure the auger motor assembly 140 to the housing 110. The auger motor assembly 140 is spaced from a bottom wall of the housing 110 to define a flow path through the lower cavity 115*b* of the housing 110 from the lower opening 116 in the front face 111 to the open back 112 of the housing 110. The solenoid 202 (FIGS. 4 and 5) is positioned within the housing 110 and fasteners (not shown) may be used to secure the solenoid 202 to the housing 110.

As described in detail above, the open back 112 of the housing 110 of the air handler assembly 100 is dimensioned to receive the evaporator/defrost assembly 170. In particular, the evaporator/defrost assembly 170 is dimensioned and positioned such that the opening 176 in the first sleeve plate 174 aligns with the flow path extending under the auger motor assembly 140 from the lower opening 116 in the front face 111 of the housing 110. The opening 184 in the bottom of the housing 172 is positioned over the sump 132 of the housing 110.

The opening 177 in the top of the evaporator/defrost assembly 170 is disposed in an upper portion of the housing 110. In particular, the opening 177 is positioned proximate the opening 154 extending through the air duct 152.

The positioning of the foregoing components defines a cooling air flow path "A" through the air handler assembly 100. In particular, the cooling air flow path "A" extends from the lower opening 116 in the front face 111 of the housing 110, under the auger motor assembly 140, into the opening 176 of the housing 172 of the evaporator/defrost assembly 170, over the evaporator 186, out through the opening 177, through the opening 154 in the air duct 152 of the evaporator fan assembly 150, through the fan 164 and out of the housing 110 through the upper opening 114 in the front face 111. In this way, the chilled air is expelled via the opening 114 to flow directly over the ice maker and then flow downwards over the ice stored in the ice bin. Thereafter, the air flows back through the opening 116.

During operation of the ice maker 50, a refrigerant is conveyed through the evaporator 186 and the fan 164 is energized. The fan 164 causes air to flow along the cooling air path "A" such that air is drawn into a lower portion of the housing 110 from the ice bin 54 and conveyed over the evaporator 186. As the air passes over the evaporator 186, the refrigerant in the evaporator 186 draws heat from the air and causes the temperature of the air to decrease. This cooler air is then conveyed by the fan 164 out of the air handler assembly 100 and over the ice tray 64 to freeze water that may be disposed in the ice tray 64.

As the air handler assembly 100 continues to convey cool air to the ice tray 64, moisture in the air collects on the evaporator 186 and other components in the air handler assembly 100 and forms frost and/or ice. As described in detail above, the air duct 152 is positioned between the fan 164 and the evaporator 186. The air duct 152 is disposed in this position so that moisture that may have condensed on the fan 164 (if the fan 164 was immediately next to the evaporator 186) may now condense on the duct 152. In addition, as noted above, the upper gap 166*a* and the lower gap 166*b* are defined between the air duct 152 and the fan 164. The upper gap 166*a* and the lower gap 166*b* are dimensioned such that it is difficult for ice accumulating on the air duct 152 to migrate or expand across the gaps 166*a*, 166*b* and to the fan 164. The air duct 152, thus, helps to hinder the buildup of condensation and ice on the fan 164.

After a predetermined period of time, the controller of the refrigerator 10 initiates a defrost cycle to melt frost and/or ice that may have accumulated in the air handler assembly 100. The controller energizes the defrost heater 194 such that heat is generated within the housing 172 of the evaporator/defrost assembly 170. The first and second sleeve plates 174, 182 are designed to distribute heat around the evaporator 186 and decrease the time needed to melt the frost and/or ice on the evaporator 186. The heat generated by the defrost heater 194 also helps to melt frost and/or ice that may have accumulated in the air duct 152 and on the fan 164. The melting frost and/or ice on the evaporator 186 form drips or streams of water that fall to the lower portion of the housing 110. The water is directed to the opening 184 in the bottom of the housing 110 and collects in the sump 132.

In addition, melting frost and/or ice on the air duct 152 form drips or streams of water that are drained from the housing 110. As shown in FIG. 9, a first drain path "B" is defined from the central portion 156*c* of the air duct 152, along the second ramped portion 156*b* and through the lower gap 166*b* between the fan 164 and the air duct 152. The water then flows out of the housing 110 through the first groove 119*a* or the second groove 119*b* in the front face 111 of the housing 110. A second drain path "C" is defined from the central portion 156*c* of the air duct 152 and along the first ramped portion 156*a*. The water is then directed into the housing 172 of the evaporator/defrost assembly 170. This water falls downward toward the opening 184 in the lower portion of the housing 172 and, together with the water from the evaporator 186 (discussed above) collects in the sump 132 of the housing 110. As described above, the channel 134 is attached to the sump 132 to convey the water out of the sump 132 through a drain tube (not shown). The foregoing drain path is illustrated as path "D" in FIG. 9.

The controller continues the defrost cycle until the thermistor 196 reaches the predetermined temperature. The controller then de-energizes the defrost heater 194. In the event that a failure or some other condition occurs that does not allow the defrost heater 194 to be de-energized, the bimetal switch 198 of the evaporator/defrost assembly 170 is designed to interrupt the flow of electricity to the defrost heater 194 at a predetermined temperature.

Referring now to FIGS. 10-15, according to another aspect, there is a provided a handle-operated door locks, such as a door lock for a domestic appliance. The embodiments discussed herein relate to a handle-operated locking mechanism for locking a door. The embodiments are discussed in the context of a domestic appliance (e.g., refrigerator, freezer, oven, dishwasher, etc.). In particular, the embodiments are discussed in the context of a refrigerator appliance for ease of explanation. However, it will be appreciated that the handle-operated locking mechanism need not be limited to refrigerators or other types of appliances, but could be applicable to other devices or structures having a door to be locked, such as a cabinet for example.

Figure 10:
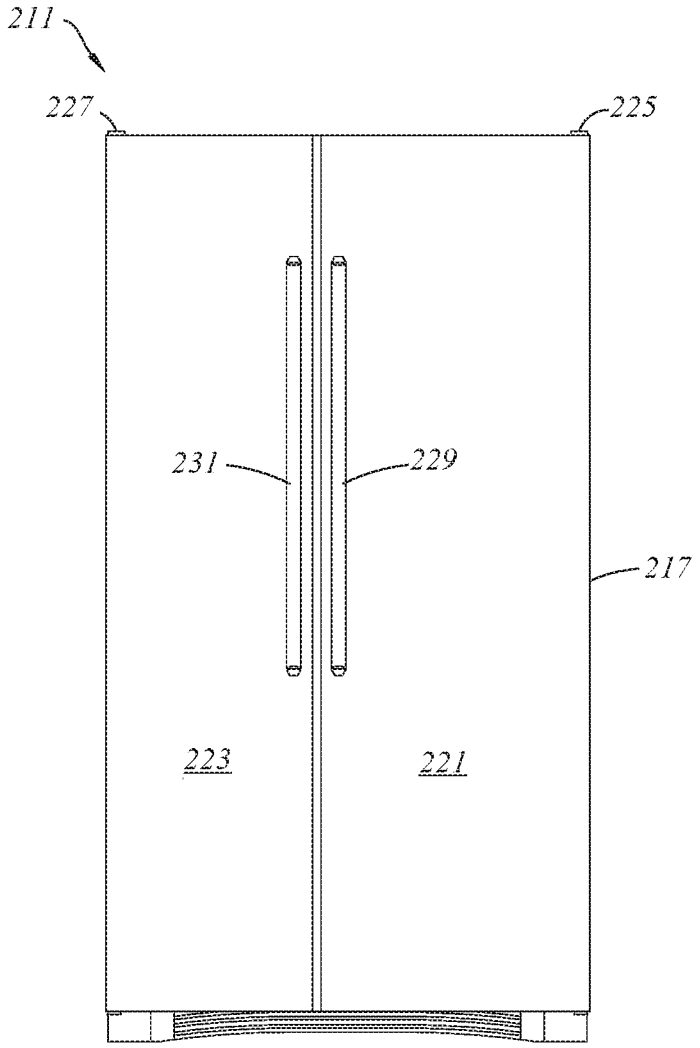
FIG. 10 is a perspective view of a side-by-side refrigeration appliance with both doors in a closed position.
Figure 11:
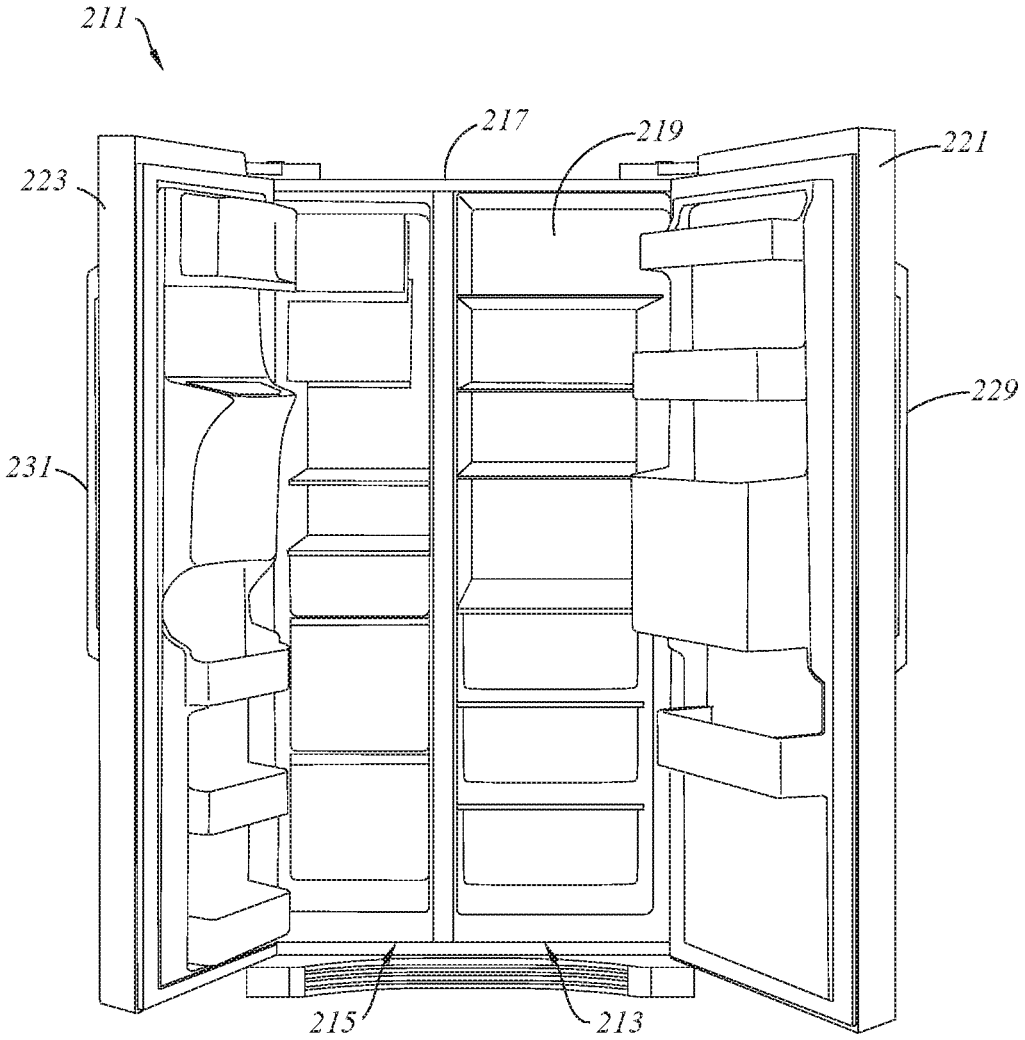
FIG. 11 is a perspective view of a side-by-side refrigeration appliance with both doors in an open position.

FIGS. 10 and 11 show a refrigerator/freezer (hereinafter "refrigerator") 211. The refrigerator is shown as a French door side-by-side refrigerator. However, the refrigerator could be a top or bottom mount refrigerator, or a single chamber refrigerator or freezer (e.g., a cabinet freezer).

The refrigerator 211 has a fresh food storage chamber 213 and a freezer storage chamber 215. The refrigerator 211 has an outer appliance housing or cabinet 217 within which the storage chambers 213, 215 are located. One or more inner liners 219 partially enclose and define the fresh food and freezer storage chambers 213, 215. Foamed-in insulation (not shown) is located between the appliance housing or cabinet 217 and the inner liner 219. A refrigeration circuit (not shown) cools the storage chambers 213, 215.

The refrigerator 211 includes movable closures (e.g., hinged doors 221, 223) for providing access to the fresh food storage chamber 213 and the freezer storage chamber 215, respectively. The hinged doors 221, 223 are movable between an open position providing access to a storage chamber (see FIG. 11) and a closed position closing the storage chamber (see FIG. 10). The doors 221, 223 close and seal the fresh food storage chamber 213 and freezer storage chamber 215 when in the closed position. In the example embodiment shown in the figures, the movable closures are configured as French doors. Each of the French doors is hinged at a respective lateral side of the appliance housing or cabinet 217. Upper hinges 225, 227 can be seen in FIG. 11, and the refrigerator 211 would typically include a lower set of hinges (not shown).

The doors 221, 223 each have an elongated handle 229, 231 mounted to the door, for opening and closing the door. The handles 229, 231 each operate a door lock, as discussed below. Attachment collars, which may be endcaps 233, 235 as shown in the figures (e.g., FIG. 12), connect the handles 229, 231 to the doors 221, 223. However, the attachment collars need not be located at the ends of the handles 229, 231 as shown, but could be located at intermediate locations along the length of the handles 229, 231.

Figure 12:
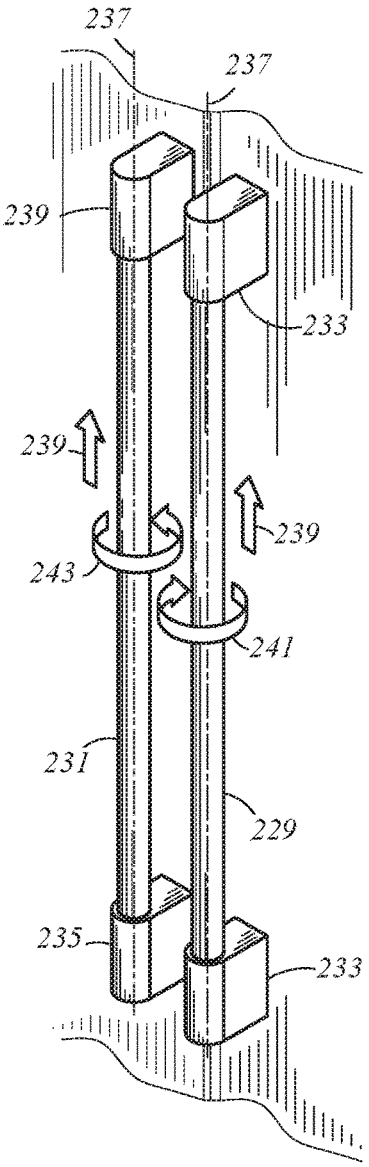
FIG. 12 is a partial perspective view of a refrigeration appliance.

FIG. 12 shows an example operation or manipulation of the door handles 229, 231 to lock the doors 221, 223. It can be seen that the handles 229, 231 are generally cylindrical and extend along a handle axis 237. A door 221, 223 is locked by a combined axial displacement of its handle along the handle axis 237 and rotation of the handle around or about the handle axis. The axial displacement is indicated by an upwards arrow 239, and the rotation is indicated by clockwise and counterclockwise arrows 241, 243. The manipulation of the handle 229, 231 to lock the door 221, 223 can be a two-step process in which the handle is first moved up or down axially, followed by the rotation of the handle clockwise or counterclockwise. Alternatively, the two-step process can require the rotation of the handle 229, 231 to precede its axial displacement. In certain embodiments, the handle 229, 231 can be axially displaced and rotated simultaneously to lock the door.

Since the handle 229, 231 must be manipulated to lock its corresponding door 221, 223 the door should not lock unexpectedly or automatically. Moreover, the combined axial and rotational movement of the handle 229, 231 can make it difficult for a child to the lock the doors 221, 223, especially if the appliance includes biasing mechanisms (e.g., a bias spring) that resist the axial displacement and rotation of the handle. The two motions required to lock the door 221, 223 can pose a complex difficulty for a child, and biasing mechanisms can make either movement of the handle (axial and/or rotational) physically difficult for a child to perform.

Various manipulations of the door handle 229, 231 could be employed to unlock the door. For example, a reverse, two-step axial translation and rotation could be required to unlock the door. Alternatively, the handle 229, 231 could be further rotated in the same direction used to lock the door 221, 223. For example, after moving the handle 229, 231 axially, rotating the handle 229, 231 clockwise to a first position locks the door 221, 223 and further rotation of the handle clockwise unlocks the door. If the handle 229, 231 is biased against rotation, requiring further rotation in the same direction used to lock the door 221, 223 and against the bias can make it difficult for a child to unlock the door. In addition to unlocking the door 221, 223 using the handle 229, 231, the refrigerator can include an interior release mechanism, to unlock the door from inside of the refrigerator.

The door handle 229, 231 can be mechanically coupled to operate a locking latch for the door 221, 223 as discussed below. Operations of the door handle 229, 231 and latch can be interlocked in other ways, such as electronically for example. Electronic interlocking between the handle and latch can include movements of the handle triggering a solenoid door latch.

Figure 13:
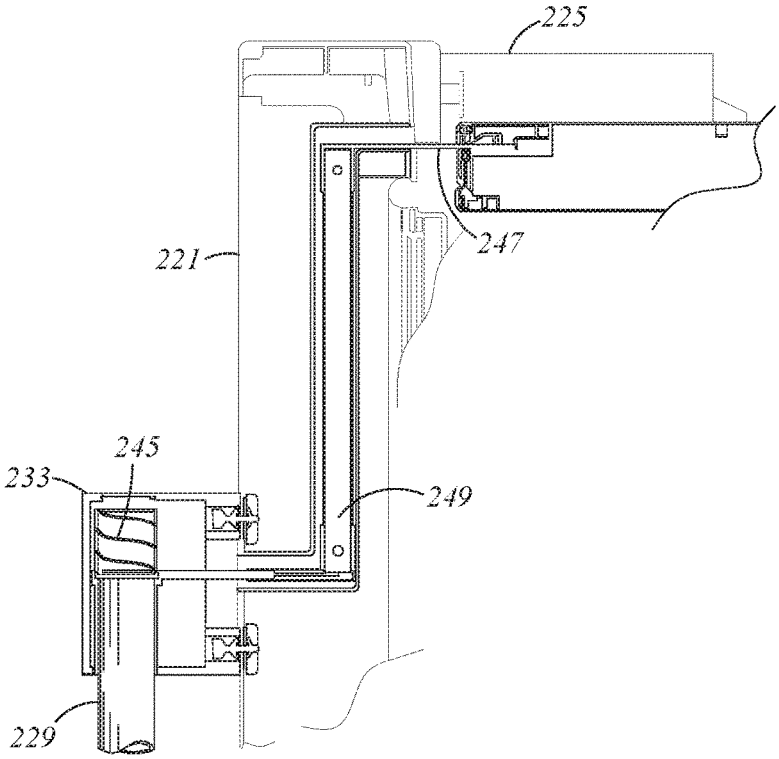
FIG. 13 shows details of a door locking mechanism for a refrigeration appliance.
Figure 14:
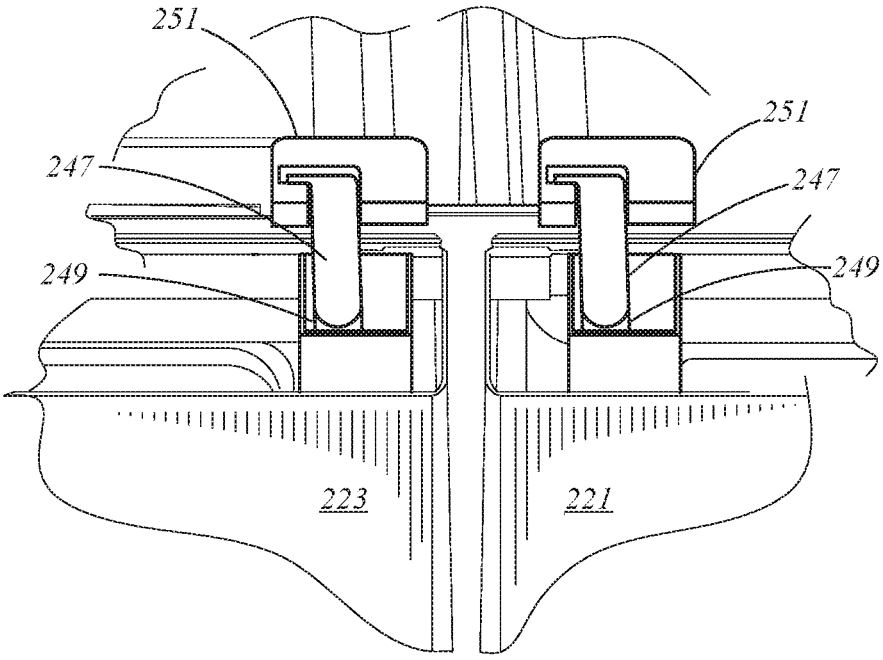
FIG. 14 shows details of a door locking mechanism for a refrigeration appliance.
Figure 15:
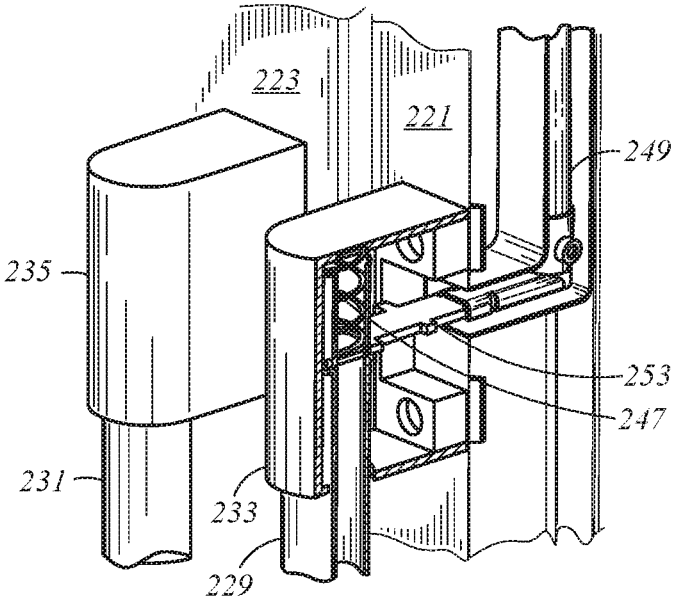
FIG. 15 shows details of a door locking mechanism for a refrigeration appliance.

FIGS. 13-15 show details of an example handle-operated in which the door handle 229 is mechanically coupled to the latch. The handle 229 can be moved axially within its endcap 233 (e.g., pushed upward or pulled downward), and be twisted about the handle axis (not shown). A bias spring 245 within the endcap 233 biases the handle 229 in an unlocked position, and resists the axial displacement of the handle 229 and/or the rotation of the handle in a clockwise or counterclockwise direction. The refrigerator can include multiple bias springs if desired, such as dedicated axial and torsional springs to resist axial displacement of the handle and twisting of the handle, respectively. Alternatively, a single bias spring can provide both axial and rotational biasing of the handle.

Although other locations on the refrigerator are possible, the latch 247 for locking the door 221 is shown located at an upper portion of the refrigerator cabinet, at a higher elevation than the handle. The latch 247 is also located rearward of the handle 229, which is attached to the front of the door 221. The door 221 includes an internal rotatable linkage 249 within the door to transfer the rotation of the handle 229 to the latch 247. The internal rotatable linkage 249 and latch 247 have a periscope shape to transfer the rotation of the handle 229 upward and rearward toward the refrigerator cabinet. The internal rotatable linkage 249 is located within the door 221 to transfer internally, either partially or entirely within the door, the rotation of the handle 229 to the latch 247.

The latches 247 at the top of the internal rotatable linkages 249 are shown in FIG. 14. The latches 247 project from the door toward the refrigerator cabinet. The refrigerator cabinet includes catches 251 that cooperate with the latches 247 to lock the doors 221, 223.

The upper end of the door handle 229 and lower end of the internal rotatable linkage 249 are shown in detail in FIG. 15. Projecting from the handle 229 is an engagement link 253 that moves axially and rotationally with the handle. The end of the engagement link 253 can have one or more teeth, pins, etc. that catch the on the internal rotatable linkage 249 as the handle 229 is moved axially. The rotation of the handle 229 is transferred to the internal rotatable linkage 249 via the engagement link 253 after the handle is moved axially upward to engage the internal rotatable linkage. Axial movement of the handle 229 can be limited by the endcap 233. Clockwise and/or counterclockwise rotation of the handle can also be limited, such as by stops located on the engagement link 253.

In certain embodiments, operation of the handles 229, 231 can assist in opening the respective door 221, 223. For example, operation of the handles via rotation and/or linear displacement can result in a pushing force being applied against the cabinet 217. The pushing force can result in the breaking of a seal formed between the doors 221, 223 and cabinet 217 when the doors are closed. The seal can be formed by a magnetic gasket located on the doors 221, 223 or cabinet. The pushing force can be applied by the latch 247 or other suitable structure (e.g., pushrod, cam surface, etc.) operatively coupled to the handles 229, 231.

The embodiment shown the figures uses a periscope-shaped internal rotatable linkage to address the vertical and horizontal offset between the handles 229, 231 and catches 251. In other embodiments, the handles can be aligned with the catches so that a periscope-shaped linkage is unnecessary. In further embodiments, the internal rotatable linkage can be eliminated and the latch can be directly operated by the engagement link, or the engagement link itself can include a latch for locking the door.

The doors 221, 223 are shown in the figures as being locked to the refrigerator cabinet. In other embodiments, the doors can be locked to each other, rather than to the cabinet. If the doors are locked to each other, only one of the door handles may be functional as a part of a handle-operated door lock.

Figure 16:
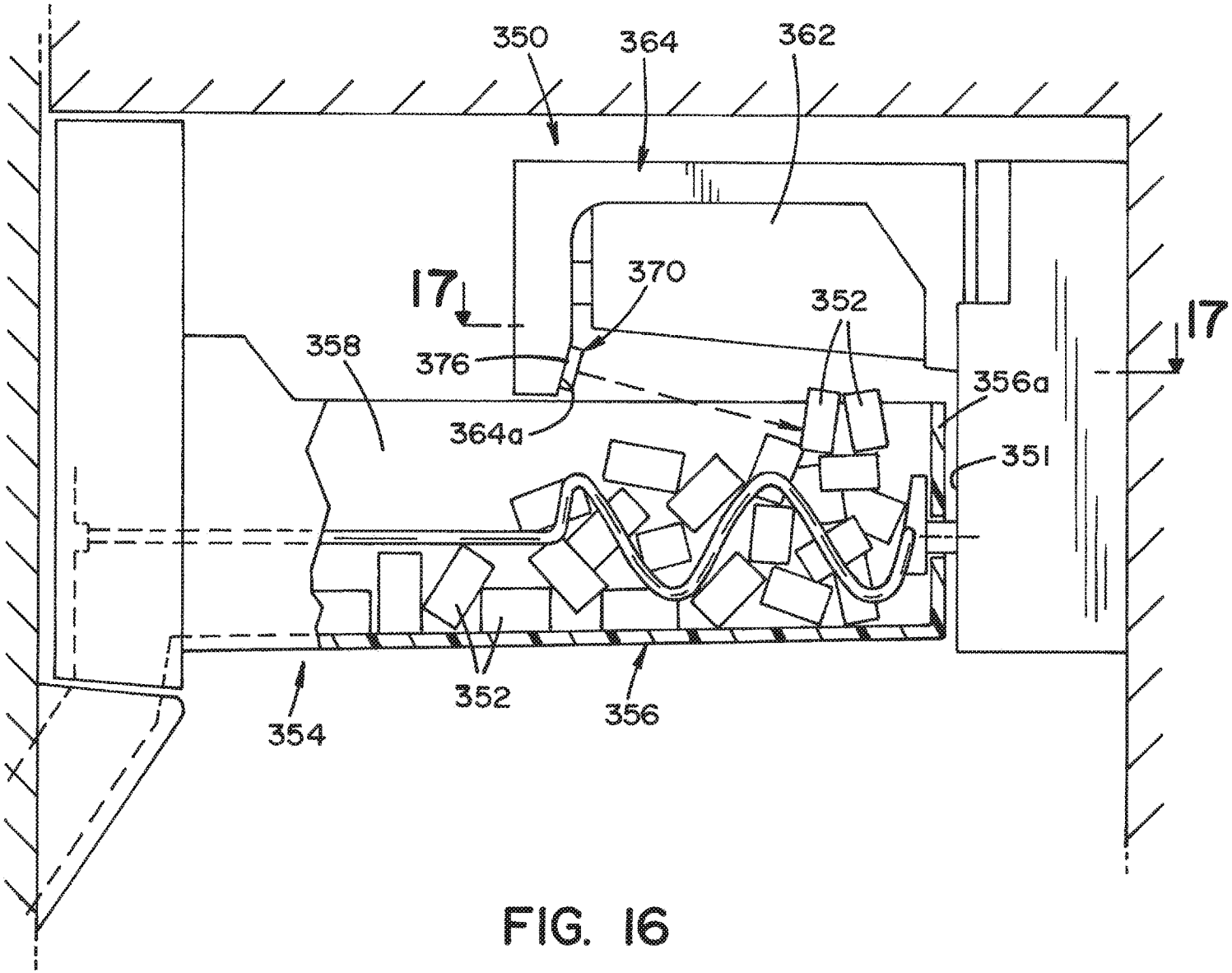
FIG. 16 is a side sectional view of an ice bin disposed within an ice maker of the refrigerator of FIG. 1 showing the ice bin in a full condition.

Referring now to FIGS. 16-22, according to yet another aspect, there is a provided a non-contact ice level sensor assembly 370 for determining the amount of ice pieces 352 in an ice bin 354 and for determining the presence/absence of the ice bin 354 in an ice maker 350. Referring to FIG. 16, the ice bin 354 is similar to the ice bin 54 described above and will not be described in detail. The ice bin 354 includes a housing 356 defining an internal cavity 358 dimensioned to store ice pieces 352 made by an ice tray 362. The housing 356 includes a rear wall **356*a* that is disposed toward a rear of the ice maker 350**.

In the embodiment shown, a frame 364 of the ice maker 350 is used to support the ice tray 362 and the ice level sensor assembly 370. It is contemplated that the ice level sensor assembly 370 could be mounted to a separate bracket/frame (not shown) so along as the ice level sensor assembly 370 is in the direct line of sight of the internal cavity 358 of the ice bin 354. In the embodiment shown, the ice level sensor assembly 370 is positioned a surface **364*a* of the frame 364. The surface 364*a* is dimensioned as described in detail below. The ice level sensor assembly 370 is positioned above the ice bin 354 when the ice bin 354 is fully inserted into the ice maker 350. The ice level sensor assembly 370 can be positioned to avoid contact with the ice bin 354 during insertion/removal of the ice bin 354 into/from the ice maker 350**.

Figure 22:
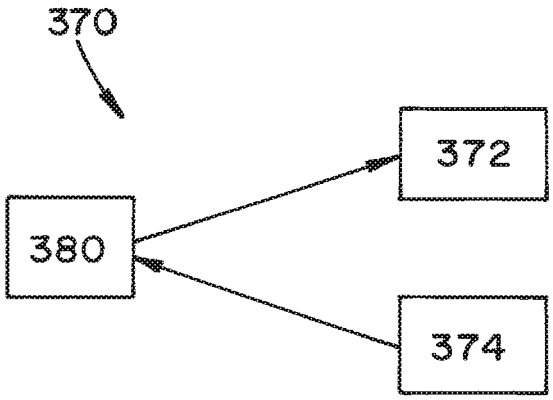
FIG. 22 is a schematic showing an emitter and receiver connected to a control unit of the refrigerator of FIG. 1.

The ice level sensor assembly 370, in general, includes an emitter 372, a receiver 374 and a controller 380, all shown schematically in FIG. 22. In the embodiment shown in FIG. 16, the emitter 372, the receiver 374 and the controller 380 are disposed in a housing 376. It is contemplated that the emitter 372, the receiver 374 and the controller 380 can be disposed in two or more separate housings (not shown).

The housing 376 is attached to the surface **364*a* of the frame 364. In the embodiment shown, the surface 364*a* is angled downward to aim the emitter 372 and the receiver 374 at a predetermined target area in the ice maker 350**. The predetermined target area is selected as described in detail below.

It is contemplated that the emitter 372 can be a vertical-cavity surface emitting laser (VCSEL) diode light source that is configured to emit photons and the receiver 374 will count the photons emitted by the emitter 372. It is contemplated that the receiver 374 can be a photon avalanche diode ("SPAD") or the like. The receiver 374 is positioned to detect the photon after it has reflected off an object. The emitter 372 and the receiver 374 are connected to the controller 380 (FIG. 22) of the refrigerator 10. It is contemplated that the ice level sensor assembly 370 can include an optical filter to filter out, i.e., reject ambient light photons. In addition, the ice level sensor assembly 370 can include crosstalk compensation in the event that a cover glass (not shown) is used.

In one embodiment, the controller 380 is a main system controller provided for controlling the operation of the refrigerator 10 (FIG. 1). The controller 380 can be mounted within the refrigerator 10 at a location that is remote from the emitter 372 and the receiver 374 but that is convenient and easily accessed by service technicians. The controller 380 can be a computer, a simple circuit board, or other control device commonly known to those skilled in the art. Preferably the controller 380 is digital, but may be partially or completely analog. In another embodiment, the controller 380 can be a dedicated ice level sensor controller which may operate independently from the main system controller.

The controller 380 may communicate with a user interface (not shown) for providing information to a user, e.g., the level of the ice pieces 352 in the ice bin 354, the absence or presence of the ice bin 354, etc. The user interface can be a simple LED display, buttons, knobs, a monitor and keypad/keyboard, a touch screen, etc. or combinations of the foregoing. Lastly, it is contemplated that the controller 380 or an attached component such as a network interface unit (not shown) can have network connectivity features, which may include any known or discovered wired or wireless network connectivity protocols (local area networks or wide area networks, including the internet), to provide remote control, status, or service features. Preferably, the wireless network connectivity protocols include WiFi, Bluetooth, NFC, ZigBee, etc.

During operation of the ice level sensor assembly 370, the emitter 372 will send out photons aimed at the predetermined target area. The predetermined target area is selected to allow the ice level sensor assembly 370 to detect at least one of the presence/absence of the ice bin 354 in the ice maker 350 and the level of the ice pieces 352 in the ice bin 354.

If an object, such as the ice piece 352 is disposed in the path of the photon emitted by the emitter 372, the photon will be reflected by the object to the receiver 374. The controller 380 is programmed to determine the distance travelled by the photon within a range of +/−1 mm based on the duration of time between when the photon was emitted by the emitter 372 and the time it was detected by the receiver 374. In other words, the ice level sensor assembly 370 performs a "time of flight" measurement of the photons emitted by the emitter 372 and subsequently detected by the receiver 374. The controller 380 is programmed such that the determined distance provides information, such as, (A) if the ice bin 354 is in place; and (B) the level of ice pieces 352 inside the ice bin 354.

Figure 17:
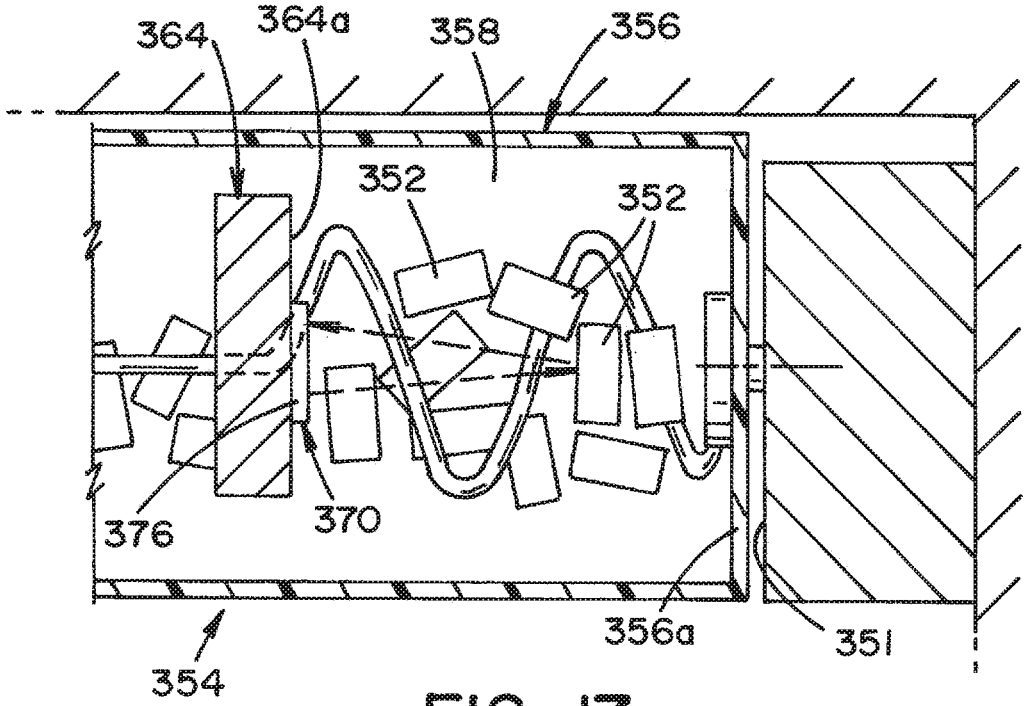
FIG. 17 is a top sectional view of the ice bin taken along line 17-17 of FIG. 16 showing a photon reflecting off an ice cube in the ice bin.

Referring to FIGS. 16 and 17, when the ice bin 354 is full the photon emitted by the emitter 372 is reflected by the ice pieces 352 located near the top of the ice bin 354. The controller 380 is programmed such that, if the photon traveled a first predetermined distance (e.g., 4 cm) the controller 380 will associate this first predetermined distance with the ice bin 354 being full. This first predetermined distance can correlate to a minimum detection distance that is either actually determined by the controller 380 or that is a programmed threshold. It is contemplated that the controller 380 may then send a corresponding signal to the appropriate system, for example, to the user interface and/or to the main controller and this system can cause the ice maker 350 to cease from adding ice pieces 352 to the ice bin 354.

Figure 19:
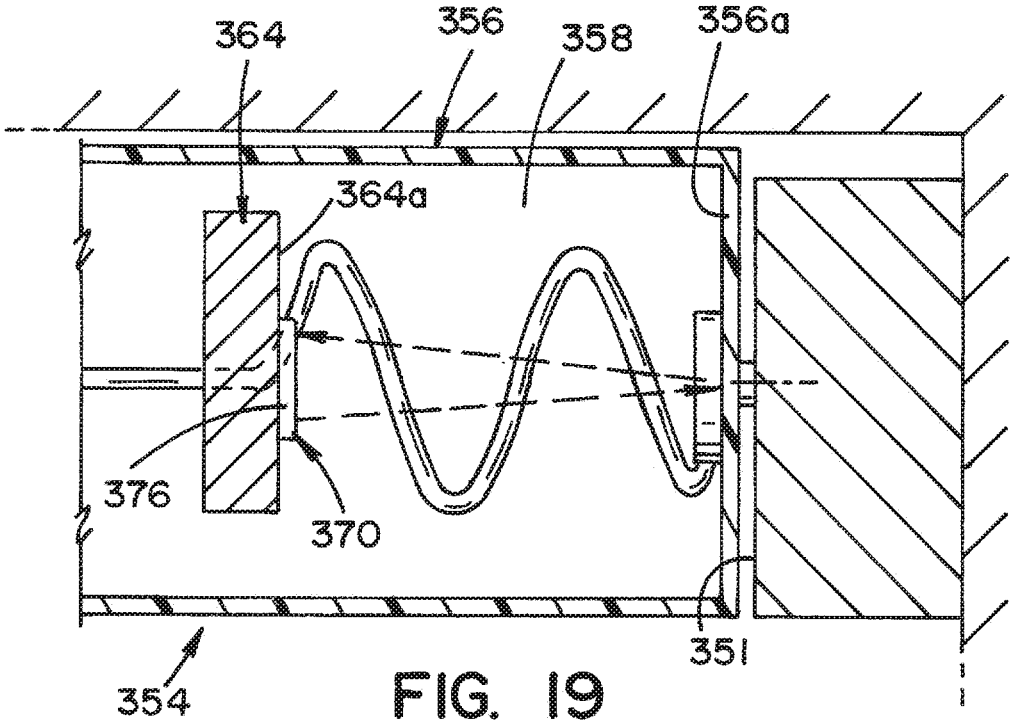
FIG. 19 is a top sectional view of the ice bin taken along line 19-19 of FIG. 18 showing a photon reflecting off a rear wall of the ice bin.
Figure 18:
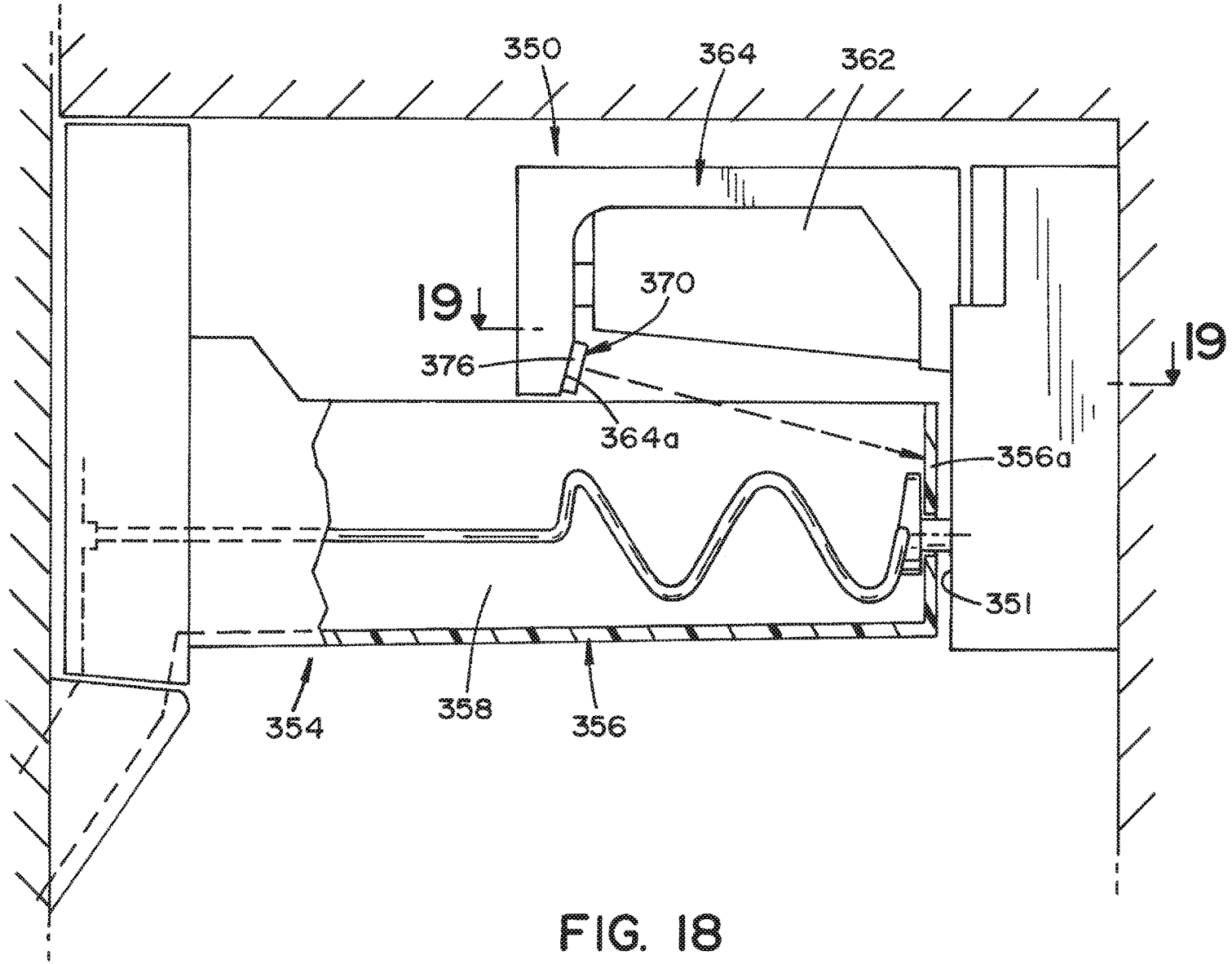
FIG. 18 is a side sectional view of the ice bin of FIG. 16, showing the ice bin empty condition.

Referring to FIGS. 18 and 19, when the ice bin 354 is empty the photon emitted by the emitter 372 is reflected by the rear wall 356*a* of the ice bin 354. The controller 380 is programmed such that, if the photon traveled a second predetermined distance (e.g., 8 cm) the controller 380 will associate this second predetermined distance with the ice bin 354 being empty. It is contemplated that the controller 380 may then send a corresponding signal to the appropriate system, for example, to the user interface and/or to the main controller and this system can cause the ice maker 350 to add ice pieces 352 to the ice bin 354.

Figure 20:
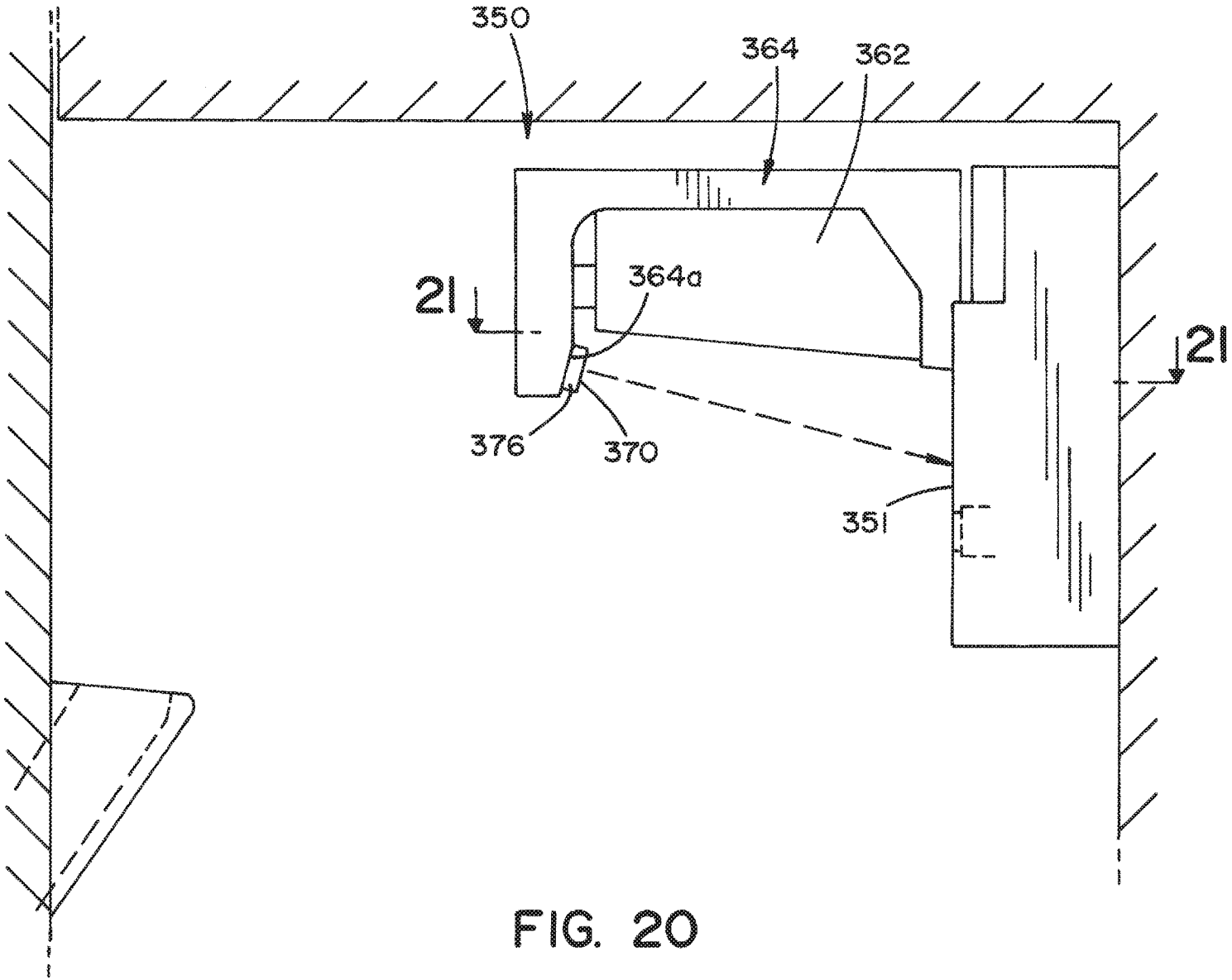
FIG. 20 is a side sectional view of ice maker of the refrigerator of FIG. 1 showing an ice bin removed from the ice maker.
Figure 21:
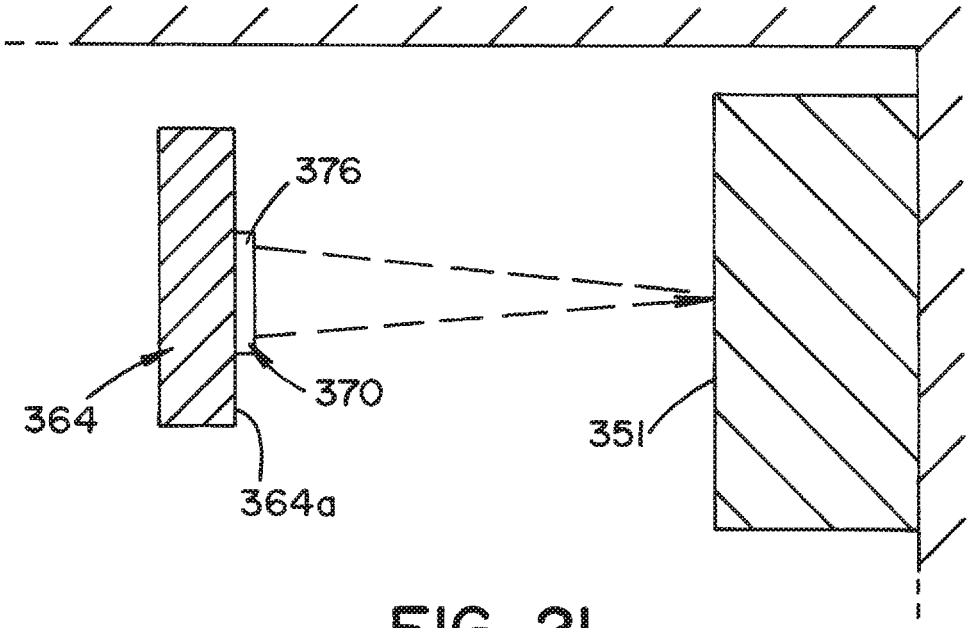
FIG. 21 is a top sectional view of the ice maker taken along line 21-21 of FIG. 20 showing a photon reflecting off a rear wall of the ice maker.

Referring to FIGS. 20 and 21, when the ice bin 354 is removed from the ice maker 350 the photon emitted by the emitter 372 is reflected by a wall 351 of the ice maker 350. The controller 380 is programmed such that, if the photon traveled a third predetermined distance (e.g., >10 cm) the controller 380 will associate this third predetermined distance with the ice bin 354 being removed from the ice maker 350. This second predetermined distance can correlate to a maximum detection distance that is either actually determined by the controller 380 or that is a programmed threshold. It is contemplated that the controller 380 may then send a corresponding signal to the appropriate system, for example, to the user interface and/or to the main controller and this system can cause the ice maker 350 to cease from attempting to add ice pieces 352 to the ice bin 354.

As described above, the controller 380 can be programmed to detect three specific conditions, (A) a full ice bin 354 (based on detecting the first predetermined distance); (B) an empty ice bin 354 (based on detecting the second predetermined distance); and (C) the ice bin 354 not disposed in the ice maker 350 (based on detecting the third predetermined distance). It is also contemplated that the controller 380 can be programmed to determine the amount of ice in the ice bin 354. Based on the first predetermined distance corresponding to a full ice bin 354 and the second predetermined distance corresponding to an empty ice bin 354, the controller 380 can be programmed to extrapolate the amount of ice in the ice bin 354 if the photon traveled a distance less than the second predetermined distance and greater than the first predetermined distance. It is contemplated that the controller 380 can be programmed to detect either an exact or an approximate amount (i.e., 25%, 50%, 75%, etc.) of ice pieces 352 in the ice bin 354. In other words, the controller 380 can be programmed to detect some variable amount of ices pieces 352 in the ice bin 354 between completely full and completely empty.

It is contemplated that the controller 380 can also be programmed to provide a signal to the user interface (not shown) that is indicative of the status of the ice bin 354, i.e., full, partially full, missing, etc. It is also contemplated that the controller 380 can be programmed to allow a user to select a desired level at which to maintain the ice pieces 352 in the ice bin 354. Upon detecting that the level of the ice pieces 352 in the ice bin 354 is at the desired level, the controller 380 can send a signal to the user interface and/or the main controller requesting that the ice maker 350 stop adding the ice pieces 352 to the ice bin 354. The desired level for the ice pieces 352 can be one of a plurality of preset ice levels or a level that is variable within a predetermined range. Upon detecting that the level of the ice pieces 352 in the ice bin 354 is below the desired level, the controller 380 can send a signal to the user interface and/or the main controller requesting that the ice maker 350 produce and add the ice pieces 352 to the ice bin 354.

It is contemplated that the ice level sensor assembly 370 can be calibrated for use with ice bins 354 of various sizes by making changes in the software in the controller 380. It is contemplated that the changes to the software can include changing the predetermined first, second and third distances to correspond to the ice bin 354 and the ice maker 350.

In the present application there is provided an ice maker for freezing water into ice pieces, the ice maker including: an ice tray for forming ice pieces; an ice bin for receiving and storing ice pieces produced by the ice tray; and an air handler assembly for conveying cooling air through the ice tray and the ice bin. The air handler assembly includes: an evaporator for cooling air conveyed through the ice tray and the ice bin, a fan for conveying the cooled air, and an air duct disposed between the evaporator and the fan for preventing the migration of ice from the evaporator to the fan, the air duct having an opening extending from an end adjacent the evaporator to an end adjacent the fan and a lower inner wall of the air duct have a first downward ramped portion on the end adjacent the evaporator.

In the foregoing ice maker for freezing water into ice pieces, the air duct is made from an insulating material.

In the foregoing ice maker for freezing water into ice pieces, the air duct is between about 2 inches and about 5 inches in length.

In the foregoing ice maker for freezing water into ice pieces, the air duct is about 3 inches in length.

In the present application, there is also provided an air handler assembly for conveying cooling air through an ice tray and an ice bin of an ice maker, the air handler assembly including: an evaporator for cooling air conveyed through the ice tray and the ice bin, a fan for conveying the cooled air, and an air duct disposed between the evaporator and the fan for preventing the migration of ice from the evaporator to the fan, the air duct having an opening extending from an end adjacent the evaporator to an end adjacent the fan and a lower inner wall of the air duct have a first downward ramped portion on the end adjacent the evaporator.

In the foregoing air handler assembly for conveying cooling air through an ice tray and an ice bin of an ice maker, the lower inner wall of the air duct further comprises a second downward ramped portion on the end adjacent the fan.

In air handler assembly for conveying cooling air through an ice tray and an ice bin of an ice maker, the second downward ramped portion is shorter than the first downward ramped portion.

In air handler assembly for conveying cooling air through an ice tray and an ice bin of an ice maker, a slope of the second downward ramped portion is greater than a slope of the first downward ramped portion.

In addition or alternatively, the ice maker of the present application may further be adapted to mounting and use on a freezer door. In this configuration, although still disposed within the freezer compartment, at least the ice maker (and possibly an ice bin) is mounted to the interior surface of the freezer door. It is contemplated that the ice mold and ice bin can be separated elements, in which one remains within the freezer cabinet and the other is on the freezer door.

Cold air can be ducted to the freezer door from an evaporator in the fresh food or freezer compartment, including the system evaporator. The cold air can be ducted in various configurations, such as ducts that extend on or in the freezer door, or possibly ducts that are positioned on or in the sidewalls of the freezer liner or the ceiling of the freezer liner. In one example, a cold air duct can extend across the ceiling of the freezer compartment, and can have an end adjacent to the ice maker (when the freezer door is in the closed condition) that discharges cold air over and across the ice mold. If an ice bin is also located on the interior of the freezer door, the cold air can flow downwards across the ice bin to maintain the ice pieces at a frozen state. The cold air can then be returned to the freezer compartment via a duct extending back to the evaporator of the freezer compartment. A similar ducting configuration can also be used where the cold air is transferred via ducts on or in the freezer door. The ice mold can be rotated to an inverted state for ice harvesting (via gravity or a twist-tray) or may include a sweeper-finger type, and a heater can be similarly used. It is further contemplated that although cold air ducting from the freezer evaporator as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a freezer drawer.

Alternatively, it is further contemplated that the ice maker of the instant application could be used in a fresh food compartment, either within the interior of the cabinet or on a fresh food door. It is contemplated that the ice mold and ice bin can be separated elements, in which one remains within the fresh food cabinet and the other is on the fresh food door.

In addition or alternatively, cold air can be ducted from another evaporator in the fresh food or freezer compartment, such as the system evaporator. The cold air can be ducted in various configurations, such as ducts that extend on or in the fresh food door, or possibly ducts that are positioned on or in the sidewalls of the fresh food liner or the ceiling of the fresh food liner. In one example, a cold air duct can extend across the ceiling of the fresh food compartment, and can have an end adjacent to the ice maker (when the fresh food door is in the closed condition) that discharges cold air over and across the ice mold. If an ice bin is also located on the interior of the fresh food door, the cold air can flow downwards across the ice bin to maintain the ice pieces at a frozen state. The cold air can then be returned to the fresh food compartment via a ducting extending back to the compartment with the associated evaporator, such as a dedicated icemaker evaporator compartment or the freezer compartment. A similar ducting configuration can also be used where the cold air is transferred via ducts on or in the fresh food door. The ice mold can be rotated to an inverted state for ice harvesting (via gravity or a twist-tray) or may include a sweeper-finger type, and a heater can be similarly used. It is further contemplated that although cold air ducting from the freezer evaporator (or similarly a fresh food evaporator) as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a fresh food drawer.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigeration appliance comprising:

a fresh food compartment for storing food items in a refrigerated environment having a target temperature above zero degrees Centigrade; and an ice maker disposed within the fresh food compartment for producing and storing ice pieces, the ice maker comprising:

an ice tray for forming ice pieces, an ice bin for receiving and storing ice pieces produced by the ice tray, an evaporator for cooling air conveyed through the ice tray and the ice bin, and an air handler assembly for conveying cooling air through the ice tray and the ice bin, the air handler assembly comprising:

a housing having at least one groove formed in a wall of the housing wherein the at least one groove extends through a front face of the housing, a fan for conveying the cooled air, the fan disposed in the housing and having a lower surface in registry with the at least one groove, and an air duct disposed in the housing between the evaporator and the fan for preventing migration of ice from the evaporator to the fan, wherein an inlet end of the air duct is disposed adjacent an outlet of the evaporator, an outlet end of the air duct is disposed adjacent an inlet of the fan, an opening extends between the inlet end and the outlet end of the air duct, and a lower inner wall bounds a bottom of the opening of the air duct, the lower inner wall having a first downward ramped portion on the inlet end of the air duct that is sloped downwardly toward the evaporator, the air duct including a notch on a leading edge of the air duct wherein the notch and an opposing side of the fan define a gap therebetween for allowing fluid to drain through the gap, through the at least one groove and to a surrounding environment.

2. The refrigeration appliance of claim 1, wherein the lower inner wall of the air duct further comprises a second downward ramped portion on the end adjacent the fan.

3. The refrigeration appliance of claim 2, wherein the second downward ramped portion is shorter than the first downward ramped portion.

4. The refrigeration appliance of claim 2, wherein a slope of the second downward ramped portion is greater than a slope of the first downward ramped portion.

5. The refrigeration appliance of claim 2, wherein at least one of the first downward ramped portion and the second downward ramped portion is curved.

6. The refrigeration appliance of claim 5, wherein the air duct is 3 inches in length.

7. The refrigeration appliance of claim 2, wherein at least one of the first downward ramped portion and the second downward ramped portion is planar.

8. The refrigeration appliance of claim 1, wherein the air duct is made from an insulating material.

9. The refrigeration appliance of claim 1, wherein the air duct is between 2 inches and 5 inches in length.

10. An ice maker for freezing water into ice pieces, the ice maker comprising:

an ice tray for forming ice pieces, an ice bin for receiving and storing ice pieces produced by the ice tray, an evaporator for cooling air conveyed through the ice tray and the ice bin, and an air handler assembly for conveying cooling air through the ice tray and the ice bin, the air handler assembly comprising:

a housing having at least one groove formed in a wall of the housing wherein the at least one groove extends through a front face of the housing, a fan for conveying the cooled air, the fan disposed in the housing and having a lower surface in registry with the at least one groove, and an air duct disposed in the housing between the evaporator and the fan for preventing migration of ice from the evaporator to the fan, wherein an inlet end of the air duct is disposed adjacent an outlet of the evaporator, an outlet end of the air duct is disposed adjacent an inlet of the fan, an opening extends between the inlet end and the outlet end of the air duct, and a lower inner wall bounds a bottom of the opening of the air duct, the lower inner wall having a first downward ramped portion on the inlet end of the air duct that is sloped downwardly toward the evaporator, the air duct including a notch on a leading edge of the air duct wherein the notch and an opposing side of the fan define a gap therebetween for allowing fluid to drain through the gap, through the at least one groove and to a surrounding environment.

11. The ice maker of claim 10, wherein the lower inner wall of the air duct further comprises a second downward ramped portion on the end adjacent the fan.

12. The ice maker of claim 11, wherein the second downward ramped portion is shorter than the first downward ramped portion.

13. The ice maker of claim 11, wherein a slope of the second downward ramped portion is greater than a slope of the first downward ramped portion.

14. The ice maker of claim 11, wherein at least one of the first downward ramped portion and the second downward ramped portion is at least one of curved or planar.

15. The ice maker of claim 11, further comprising at least one of the following:

the evaporator including a metal housing defining a flow path through the evaporator, and the air handler assembly including a housing having an open end and an over-molded gasket disposed around a periphery of the open end of the housing.

* * * * *